US006530432B2

(12) United States Patent
Gipson

(10) Patent No.: US 6,530,432 B2
(45) Date of Patent: Mar. 11, 2003

(54) OIL WELL TUBING INJECTION SYSTEM AND METHOD

(75) Inventor: Tommie C. Gipson, Eastland, TX (US)

(73) Assignee: Coiled Tubing Solutions, Inc., Eastland, TX (US)

( * ) Notice: Subject to any disclaimer, the term of this patent is extended or adjusted under 35 U.S.C. 154(b) by 0 days.

(21) Appl. No.: 10/135,130

(22) Filed: Apr. 29, 2002

(65) Prior Publication Data

US 2003/0010505 A1 Jan. 16, 2003

Related U.S. Application Data

(60) Provisional application No. 60/304,681, filed on Jul. 11, 2001.

(51) Int. Cl.[7] ..... E21B 19/22

(52) U.S. Cl. ..... 166/384; 166/77.2; 175/162; 226/189; 242/397.2

(58) Field of Search ..... 166/77.2, 384, 166/385, 85.5, 85.1, 379, 242.2, 77.3; 175/162, 173, 195, 57; 226/189, 190, 188, 187, 194, 108; 242/397.1, 397.2, 397.5, 420.6

(56) References Cited

U.S. PATENT DOCUMENTS 2,262,364 A * 11/1941 Hugel et al. ..... 15/104.33
3,176,335 A 4/1965 Ciaccio et al.
3,285,485 A 11/1966 Slator (List continued on next page.)

*Primary Examiner*—David Bagnell
*Assistant Examiner*—Shane Bomar
(74) *Attorney, Agent, or Firm*—Elizabeth R. Hall & Associates, P.C.

(57) ABSTRACT

The injector of the invention provides a means and method for injecting either coiled tubing or conventional stalked tubing into and from a well by developing axial forces in the tubing. The curvature of the coiled tubing is simultaneously selectably altered on the opposite side of the injector from the wellhead. To develop traction on the tubing, the injector relies upon an array of opposed pairs of annularly grooved driven rollers which are urged into contact with the tubing. The pairs of rollers are mounted in an alternating pattern 90° apart so that the tubing is well supported and urged into roundness. Integral with the injector, but deactivated when the injector is used with stalked tubing, is a selectably operable tubing straightener which serves to straighten the tubing before entry into the well and also to recurve the tubing when being withdrawn from the well to control its arcuate path between the injector and the tubing storage reel. Additionally, the injector unit has an integral slip unit for gripping the tubing in cases when it is desirable to support the tubing axially without operating the tractive portion of the injector.

42 Claims, 33 Drawing Sheets

U.S. PATENT DOCUMENTS 3,313,346 A 4/1967 Cross
3,363,880 A 1/1968 Blagg
3,380,545 A 4/1968 Kemper
3,393,415 A 7/1968 Ciaccio
3,469,273 A 9/1969 Caperton
3,559,905 A 2/1971 Alexander
3,658,270 A 4/1972 Slator et al.
3,777,964 A * 12/1973 Kruner et al. ..... 226/183
3,872,680 A * 3/1975 Nicholson et al. ..... 242/397.5
3,986,652 A * 10/1976 Perkins ..... 226/181
4,585,061 A * 4/1986 Lyons et al. ..... 166/77.3
4,673,035 A 6/1987 Gipson
4,743,175 A * 5/1988 Gilmore ..... 166/77.2
5,094,340 A 3/1992 Avakov
5,188,174 A 2/1993 Anderson, Jr. et al.
5,289,845 A 3/1994 Sipos et al.
5,309,990 A 5/1994 Lance
5,439,066 A * 8/1995 Gipson ..... 166/177.6
5,553,668 A * 9/1996 Council et al. ..... 166/77.3
5,828,003 A 10/1998 Thomeer et al.
5,842,530 A 12/1998 Smith et al.
5,850,874 A 12/1998 Burge et al.
5,934,536 A * 8/1999 Shore et al. ..... 226/177
5,937,943 A 8/1999 Butler
5,944,099 A 8/1999 Sas-Jaworsky
6,003,598 A 12/1999 Andreychuk
6,142,406 A * 11/2000 Newman ..... 166/77.2
6,220,807 B1 4/2001 Sorokan
6,273,188 B1 * 8/2001 McCafferty et al. ..... 166/77.2
6,276,454 B1 * 8/2001 Fontana et al. ..... 166/343
6,332,501 B1 * 12/2001 Gipson ..... 166/384
6,343,657 B1 * 2/2002 Baugh et al. ..... 166/241.1
6,382,322 B1 * 5/2002 Gipson ..... 166/242.2
6,408,955 B2 * 6/2002 Gipson ..... 166/384

* cited by examiner

OIL WELL TUBING INJECTION SYSTEM AND METHOD

CROSS-REFERENCE TO RELATED APPLICATION

The present application, pursuant to 35 U.S.C. 111(b), claims the benefit of the earlier filing date of provisional application Serial No. 60/304,681 filed Jul. 11, 2001, and entitled "Coiled Tubing Injector Utilizing Opposed Drive Modules and Having An Integral Bender." The present application is also related to U.S. patent application Ser. No. 09/977,784, filed Oct. 15, 2001 and entitled "Rollers for Coiled Tubing Injectors."

FIELD OF THE INVENTION

The present invention relates to a method and apparatus for injecting and withdrawing coiled tubing into and from a well bore. More particularly, the system injects coiled and stalked tubing into a well bore from a tubing storage source or device and withdraws the tubing from the well bore and returns it to the storage source.

BACKGROUND OF THE INVENTION

Devices and methods for injecting coiled tubing into and retrieving it from wells are well known. Previous injection systems are described in U.S. Pat. Nos. 6,142,406; 5,842,530; 5,839,514; 5,553,668; 5,309,990;. 5,244,046; 5,234,053; 5,188,174; 5,094,340; 4,899,823; 4,673,035; 4,655,291; 4,585,061; and other similar disclosures. Tubing injectors are used to grip and control the injection and withdrawal of the tubing at the wellhead. However, certain limitations influence the efficiency of the injection and withdrawal processes. One particular problem is the drag of the injected tubing along the inner walls of the drilled hole or casing resulting from the presence of residual curvature in the coiled tubing after its passage through the injector when it is being inserted into the well. As a result of this drag, additional injection forces must be applied to the tubing both to inject and to withdraw the tubing.

Conventional track injectors utilize gripper blocks mounted on two continuous parallel and opposed conveyor chains which are urged or pushed against the outer surface of the tubing. The interface forces between the gripper blocks and the tubing permit developing frictional forces which are used to transfer tangential loads from the conveyor chains to the tubing and vice versa. If insufficient interface force is applied to the tubing by the gripper blocks, slippage with attendant loss of control and wear occurs between the blocks and tubing. If excessive interface force is applied to the tubing by the gripper blocks, the tubing wall may be distorted and damaged or the injector may be damaged.

Historically, the approach used to increase the injection forces with conventional track injectors has been to lengthen the injector while maintaining a sufficiently safe interface force between the individual gripper blocks and the tubing. U.S. Pat. No. 5,842,530 for example shows provision of substantially more gripper blocks along the length of its injector.

Other injectors utilizing two continuous, parallel, and opposing track injectors having grooved shoes or blocks mounted thereon are known in the art. These opposing track units have facing portions where the multiplicity of gripping blocks run parallel for gripping the tubing therebetween and are typically positioned in line, directly adjacent and above the wellhead.

Another approach has been to utilize a large diameter driven wheel with an annularly grooved outer diameter to conform to and support the tubing. Hold-down idler rollers radially press the tubing against the wheel to provide extra interface force between the tubing and the wheel so that high tangential frictional forces can be imparted to the tubing by the wheel. While the mechanism of wheel type injectors is simple, inexpensive, and reliable, wheel size can be a limitation, especially for larger tubing diameters. One such wheel type injector is disclosed in U.S. Pat. No. 5,839,514.

A more recent injector system known in the art is a linear injector which pulls on only one side of the tubing. For this type of device, coiled tubing is driven along a single linear section of an endless chain conveyor with an opposing linear array of hold-down idler rollers. Such a linear or one-track injector eliminates the necessity of synchronizing the two opposed sides of a conventional track type injector and is less damaging to the surface of the coiled tubing, but it requires a much longer unit, which of necessity extends much higher and requires additional overhead clearance. Additionally, such an injector is more expensive because it requires a considerable number of gripper blocks and rollers and a longer support track.

There remains an existing need for an improved injector that can reduce damage to the surface of the coiled tubing while allowing an easier means for changing out the tubing size.

SUMMARY OF THE INVENTION

The present invention utilizes a novel approach to imparting tangential injection forces to the tubing. The driving means of this invention provides full support around the circumference of the tubing. By using a plurality of sets of opposed individually driven annularly grooved rollers which closely conform to the tubing and alternating the orientations of adjacent roller sets so that they are 90° apart about the through axis of the injector, excellent tubing support is provided. The tubing injector of the present invention is light weight and compact and can fit with the other components for the injection system onto a truck, a trailer, or a skid.

One aspect of the present invention is a traction drive unit for imparting axial loads to tubing, the drive unit includes:

(a) a pair of drive modules, each drive module comprising a housing having a central window, an independent drive motor with an output shaft, and a roller having a circumferential annular groove aligned with the central window of the housing, the roller supported by rotary bearings and driven by the output shaft of said drive motor, wherein the rollers of the pair of drive modules are opposed and independently driven; and (b) biasing means for independently urging the roller of each drive module into engagement with a tubing supported by the opposed rollers. Another aspect of the present invention is a tubing injector comprising:

(a) a traction drive unit for imparting axial loads to tubing, the drive unit having a plurality of pairs of drive modules, where each drive module includes a housing, an independent drive motor with an output shaft, and a bearing-supported roller in contact with a tubing, the roller driven by the output shaft of the drive motor such that each pair of drive modules have opposed and independently driven rollers;

(b) tensioning means for independently controlling the axial load applied to the tubing by each roller; and (c) an injector housing, wherein the pairs of drive modules are mounted in the injector housing in an alternating pattern 90° apart along an axis of the injector housing.

Yet another aspect of the present invention is an arc corrector having:

(a) a plurality of flex modules, each flex module having
  (i) a tubular housing having a tube axis;
  (ii) a pair of independently inwardly biased independently driven drive modules, said drive modules having a module housing, an independent drive motor with an output shaft, and a bearing-supported roller driven by the output shaft of the drive motor;
  (iii) biasing means for independently urging the roller of each drive module into engagement with a tubing supported by the opposed rollers;
  (iv) a plurality of coaxial linking pin holes perpendicular to and intersecting the housing tubing axis; and
  (v) two cylinder mounting eyes located off the housing tube axis perpendicular to the plane defined by the linking pin hole axes and equispaced from the transverse midplane of the housing;

(b) a plurality of linking pins, wherein one linking pin engages one linking pin hole in each of two adjoining flex modules to interconnect the adjoining flex modules; and (c) a plurality of hydraulic cylinders, the cylinders cojoining the cylinder mounting eyes of adjacent flex modules, wherein selective application of pressure to the hydraulic cylinders between interlinked flex modules imparts a change in curvature to the tubing supported by the opposed rollers of the flex modules.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

The novel features which are believed to be characteristic of the invention, both as to its organization and methods of operation, together with the objects and advantages thereof, will be better understood from the following description taken in conjunction with the accompanying drawings, wherein.

DETAILED DESCRIPTION OF THE INVENTION

The tubing handling system of the present invention utilizes a novel approach to imparting tangential injection forces to the tubing. The driving means of this invention provides full support around the circumference of the tubing. To develop traction on the tubing, the present invention relies upon an array of opposed pairs of annularly grooved driven rollers urged into contact with the tubing. The pairs of rollers are mounted in an alternating pattern 90° apart so that the tubing is well supported and urged into roundness.

The tubing drive means of the present invention provides an effective tubing injector and means for correction of the arcuate path of coiled tubing between the storage reel and the injector. The use of the drive means in a tubing injector will be described first. Integral with the injector is a selectably operable tubing curvature adjuster of novel construction which serves to straighten the tubing before entry into the well and also to recurve the tubing when being withdrawn from the well to control its arcuate path between the injector and the tubing storage reel. Additionally, the injector unit has an integral slip unit for gripping the tubing in cases when it is desirable to support the tubing axially without operating the tractive portion of the injector.

The tubing injector of the present invention is light weight and compact and can fit with the other components for the tubing handling system onto a truck, a trailer, or a skid.

Figure 1:
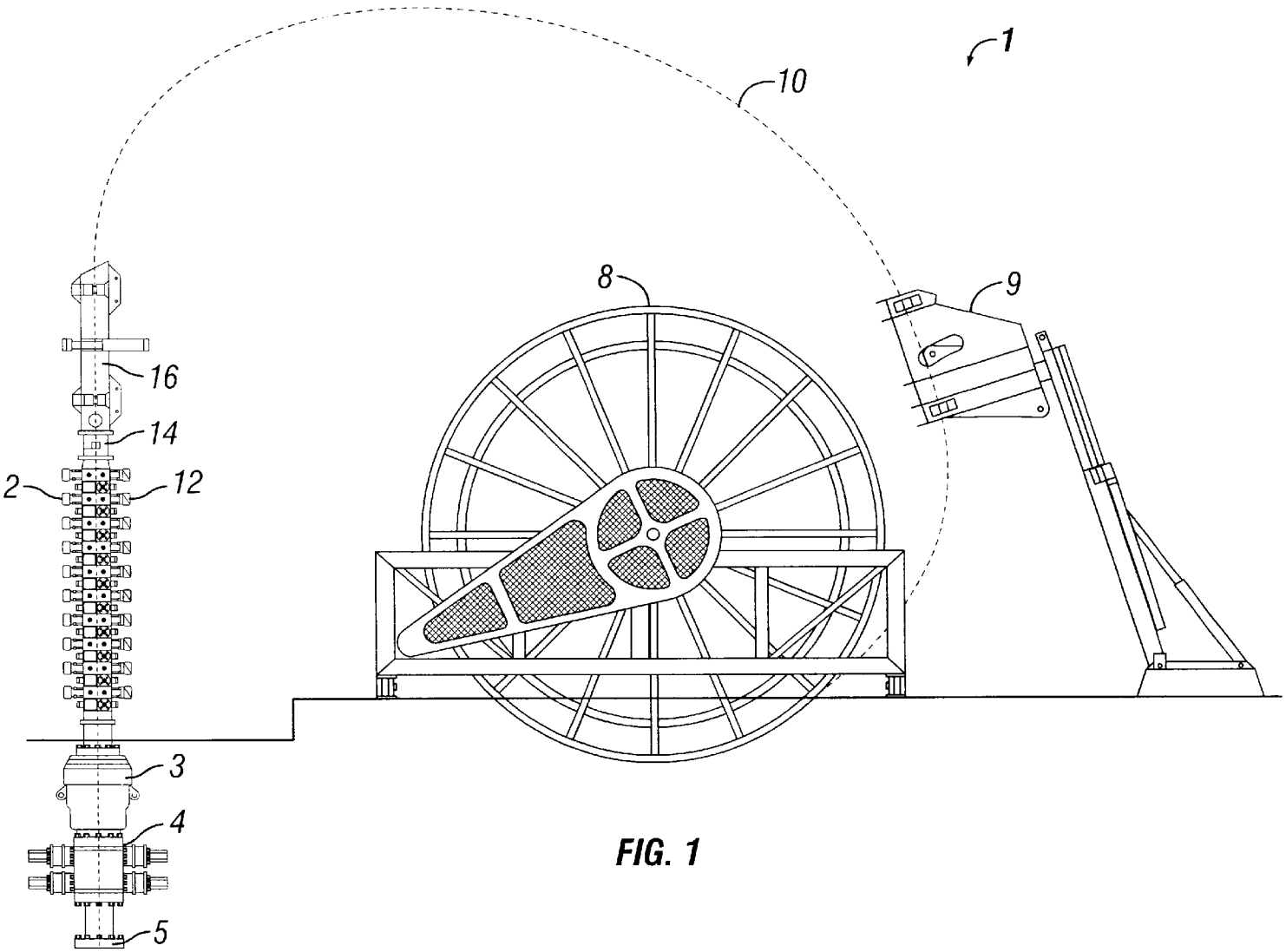
FIG. 1 is a partially schematic view showing the tubing injection system of set up on a well, but with the mounting trailer and structural supports for the injector removed for clarity.

Referring now to the drawings, and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment.

Referring to FIG. 1, a coiled tubing rig 1 based on this invention is shown. The basic elements of the rig 1 are the injector unit 2, the spherical blowout preventer 3, the ram blowout preventer 4, the flanged connector spool 5, the tubing storage reel 8, the level wind unit 9, and the tubing 10. The tubing 10 runs from the storage reel 8 through the level wind unit 9 and thence into the injector unit 2 and into the wellhead through the preventers 3 and 4 and connector spool 5. Flanged connector spool 5 is bolted to the wellhead of a preexisting well, along with the blowout preventers 3 and 4 in order to provide well control. The tubing is fed into the well for performing well operations known to those skilled in the art.

The Tubing Injector of the Present Invention

Figure 2:
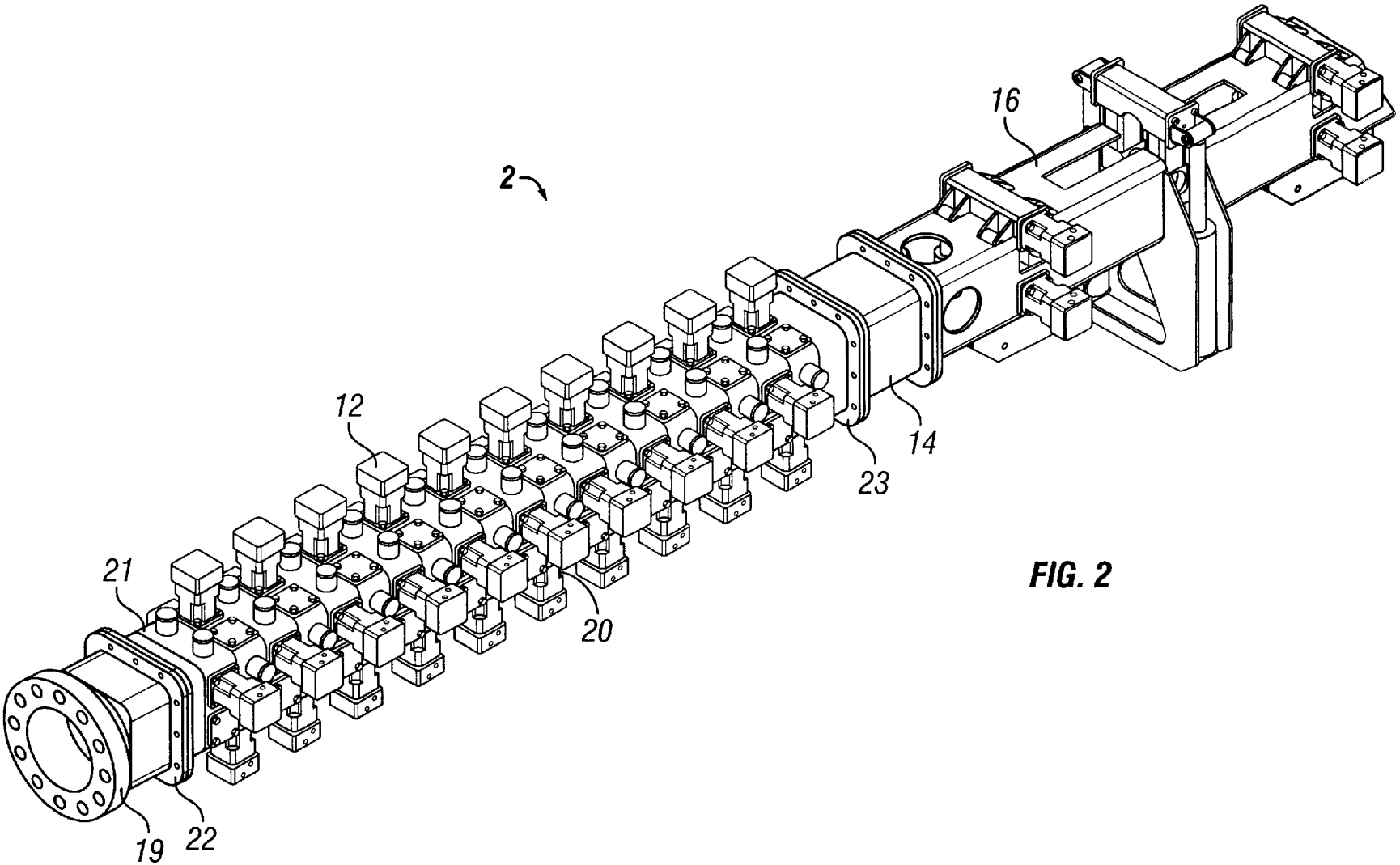
FIG. 2 is an oblique view of the tubing injector with its integral tubing curvature adjuster.

FIG. 2 shows an oblique view of one embodiment of the injector unit 2 of this invention. Injector unit 2 consists of traction drive 12, slip unit 14, tubing straightener 16, and adapter spool 19. Adapter spool 19 is joined by bolts to the lower flange 22 at the bottom end of traction drive body 21. The coiled tubing is passed approximately coaxially through the traction drive 12.

Figure 3:
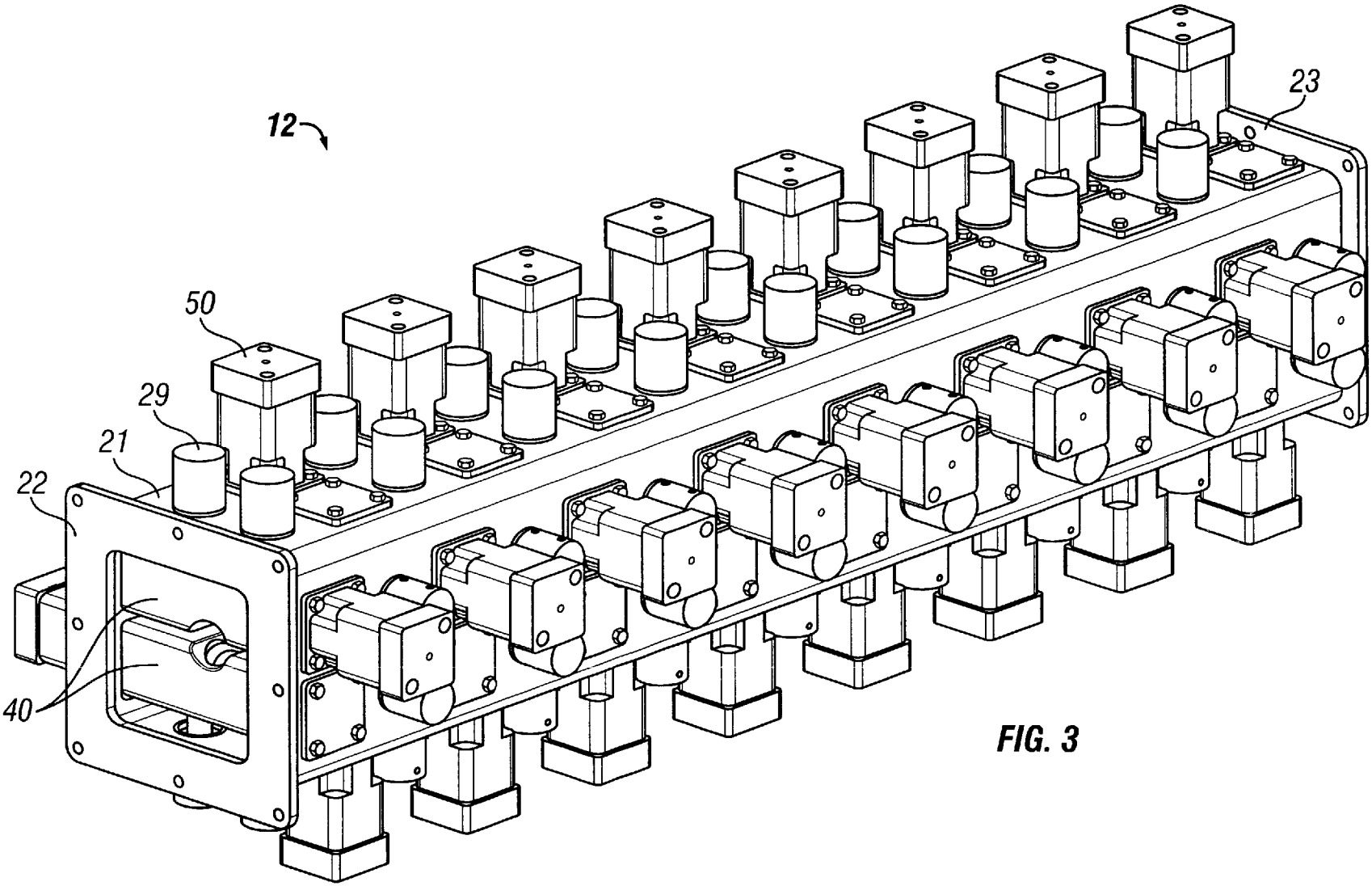
FIG. 3 shows an enlarged oblique view of the traction device of this invention.

The traction drive 12 is shown in more detail in FIG. 3. Traction drive body 21 consists primarily of a length of steel square structural tubing approximately 16×16 inches in cross section and having approximately a ⅝ inch wall. The upper and lower ends of body 21 have lower 22 and upper 23 transverse flanges welded onto the main tube. Upper flange 23 of traction drive body 21 is connected by bolts to the comating similar bottom flange of the housing of slip unit 14. The upper flange of slip unit 14 is joined to the bottom flange of tubing straightener 16 by bolts.

Figure 4:
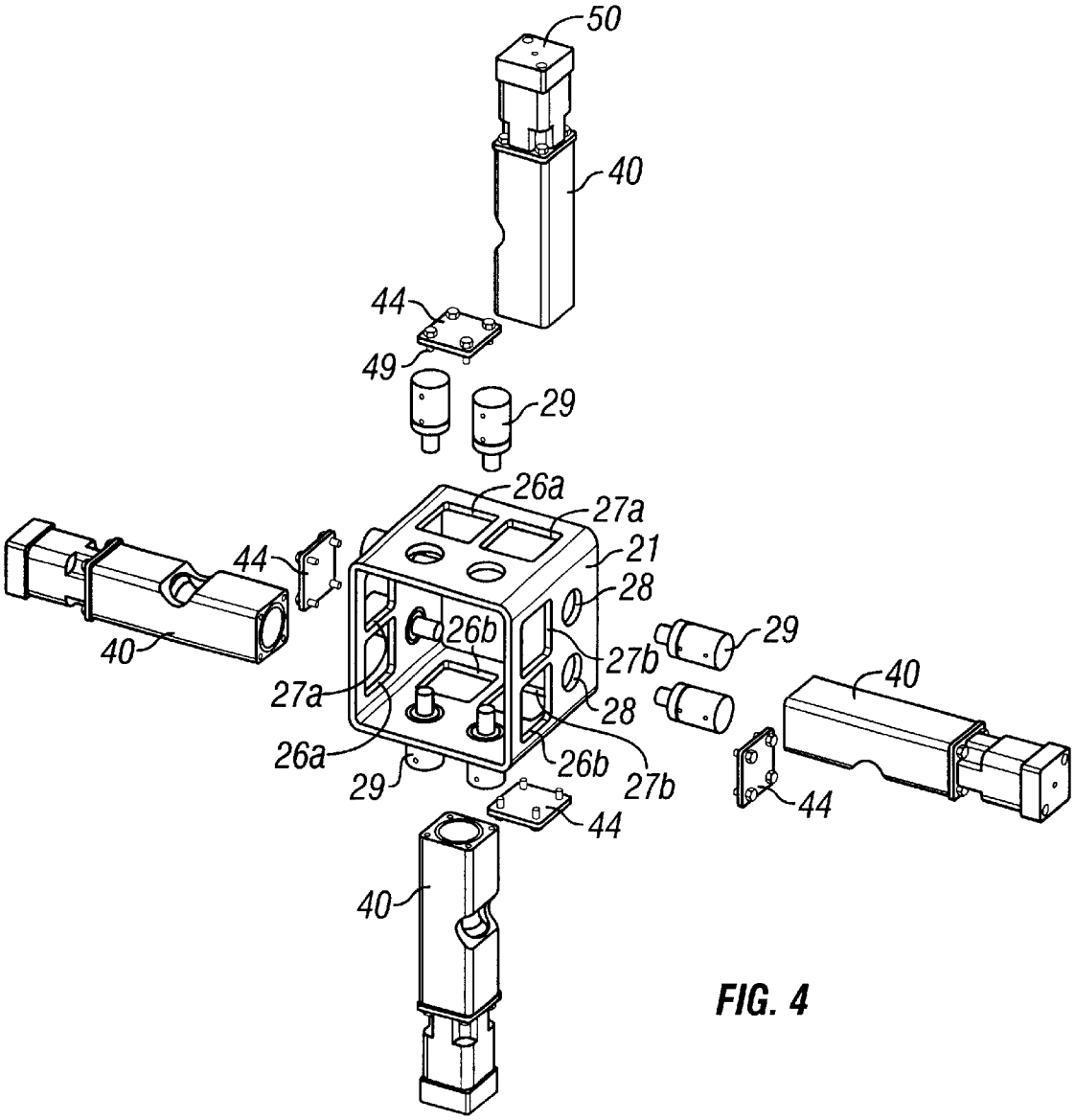
FIG. 4 shows an exploded oblique view of a segment of the traction device of this invention with two sets of opposed drive modules and the engagement devices used to cause the drive modules to grip the tubing.

As seen in FIGS. 2 and 3, the traction drive 12 has a repetitive array of multiple drive modules extending from each of its four lateral sides. FIG. 4 shows an exploded view of a portion of traction drive body 21 holding two opposed pairs of drive modules 40. The components shown in FIG. 4 are arrayed in a repetitive pattern along the length of traction drive 12. Identical rectangular coaxial lower and upper drive module ports 26*a,b* and 27*a,b,* respectively, with rounded corners are cut with mirror image symmetry about a longitudinal midplane of symmetry of traction drive body 21. Ports 26*a,b* and 27*a,b* are elongated slightly in the direction normal to the midplane plane of symmetry. In the same transverse plane containing ports 26*a,b* and 27*a,b* but normal to the aforementioned longitudinal midplane are two pairs of coaxial threaded squeeze cylinder mount holes 28 which are used to threadedly mount two pairs of opposed, inwardly looking hydraulic or spring driven squeeze cylinders 29. The holes 28 are symmetrical about the centerline of traction drive body 21.

Short-stroke squeeze cylinders 29 each have a male thread on the rod end of their stub cylindrical bodies and are threaded into mount holes 28. The squeeze cylinders may be seen more clearly in FIG. 5. Each cylinder 29 has a piston rod 30 with a flat outer end. Internal to squeeze cylinder 29 is cylinder bias spring 31 which biases rod 30 to extend inward. Spring 31 may be of coil, Belleville, wave spring, or other construction, as is known to those skilled in the art. Cylinders 29 may be provided with retractor screws engageable with piston rods 30 to overcome the spring forces when it is necessary to disengage the cylinders from bearing on the drive modules 40. Alternatively, if the cylinders are made double-acting hydraulic cylinders, hydraulic pressure can be used to retract the piston rods 30. For such an arrangement, the hydraulic pressure also could be used in tandem with or instead of springs 31 to provide bias force against the drive modules 40.

Figure 5:
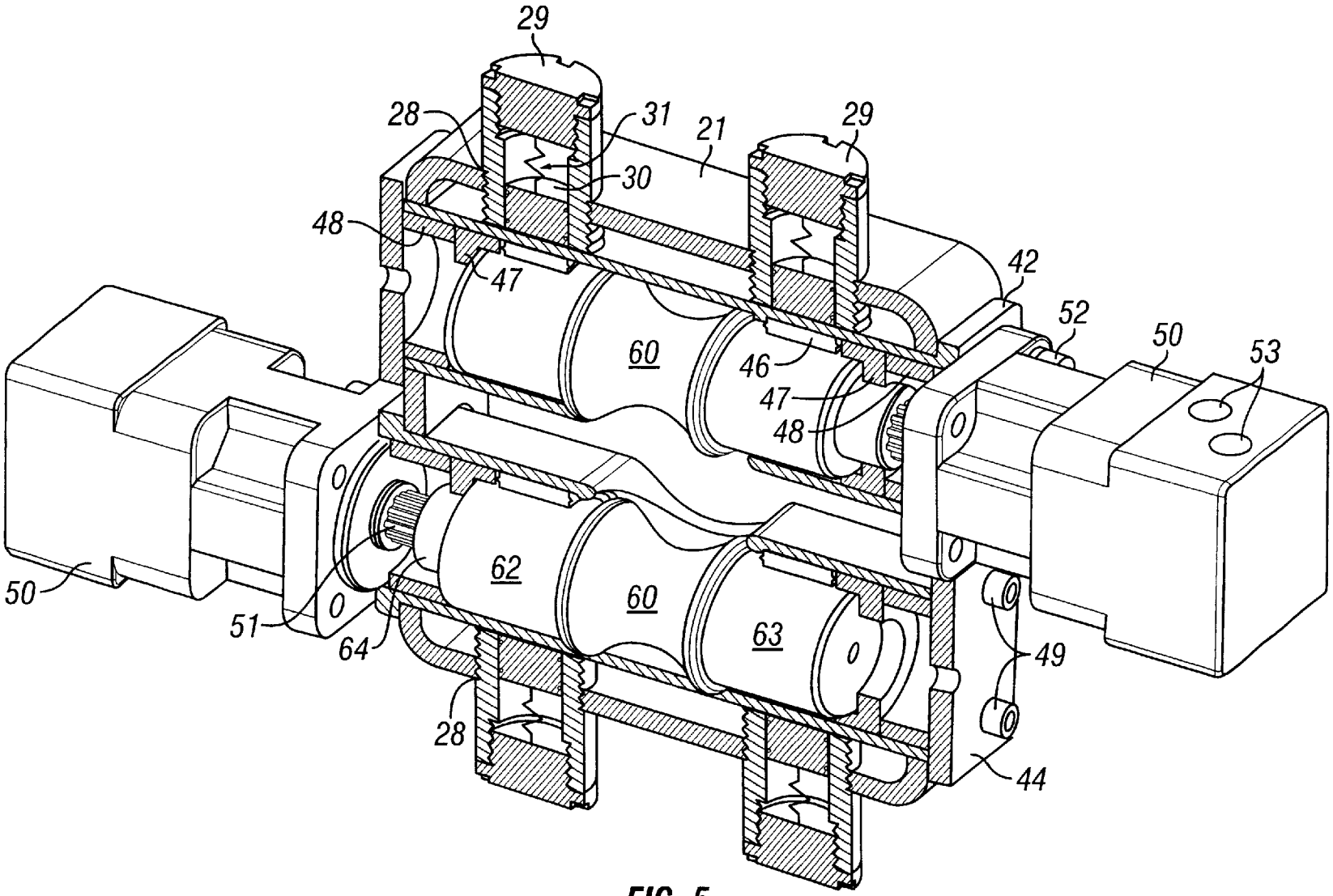
FIG. 5 shows an oblique view of a transverse partial cross-sectional view of the traction device through the centerline of an opposed drive module pair.

Adjacent a first opposed pair of drive module ports 26*a,b* and 27*a,b* and its associated cylinder mount holes 28 is a similar arrangement of ports and cylinder mount holes which has its midplane of symmetry rotated 90° relative to the first set. These ports 26*a,b* and, similarly, 27*a,b* are configured to accept axial insertion and mounting therein of drive modules 40. For clearance reasons, the drive modules 40 may be inserted from opposite directions into ports 26*a,b* and 27*a,b,* as is shown in FIGS. 2, 3, and 4. When drive modules 40 are being inserted into the mounting ports in traction drive body 21, piston rods 30 of squeeze cylinders 29 are retracted as shown in FIG. 5. Once inserted, cylinders 29 are positioned to urge drive modules 40 toward the centerline of traction drive body 21 so that their drive mechanisms can transversely contact any coiled tubing which is deployed through the injector unit 2.

Figure 6:
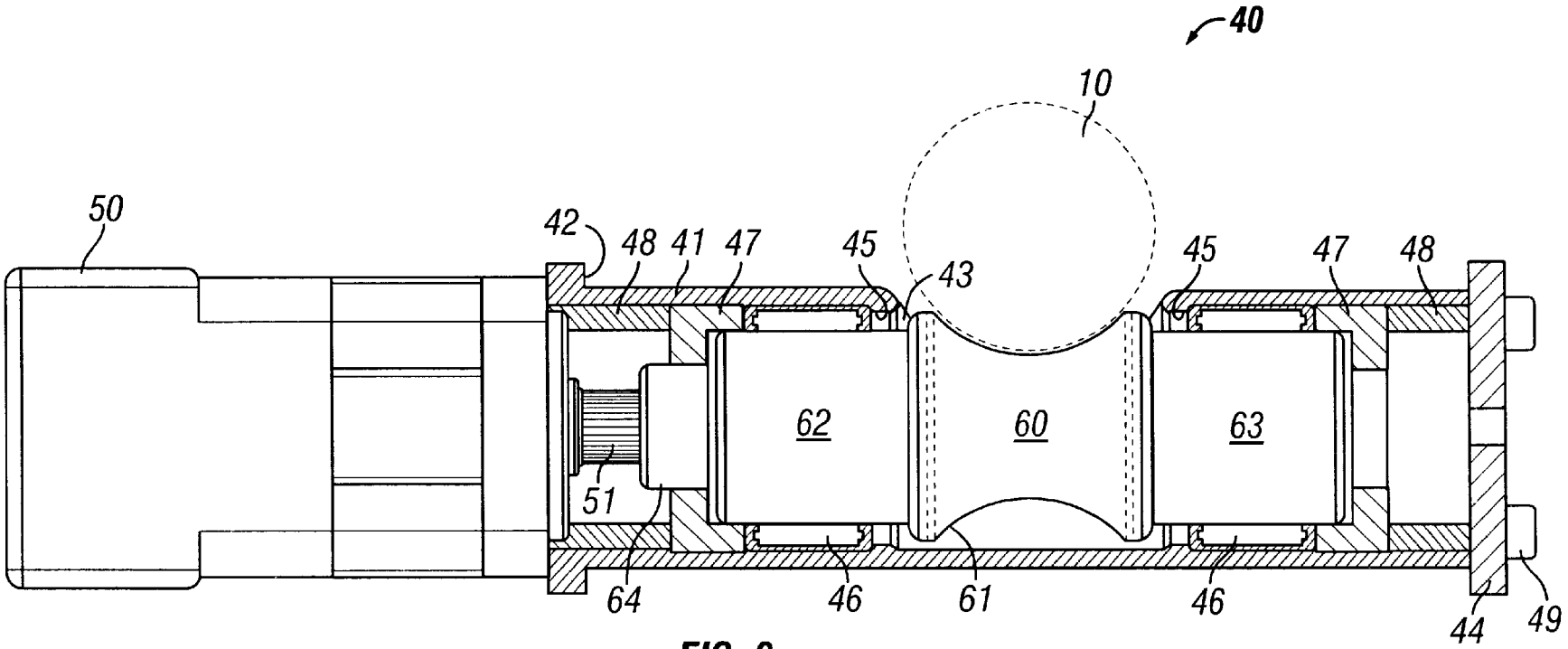
FIG. 6 shows a longitudinal cross-section of a second type of drive module used in the injector of this invention using a one-piece drive roller.

Referring to FIG. 6, single tired drive module 40 consists of a square cross-section drive module body 41, a hydraulic drive motor 50, and drive roller 60, along with associated hardware. Drive module body 41 has a through bore with two internal transverse shoulders and square motor mount flange 42 at its first end. The flange face of motor mount flange 42 is configured to mount motor 50 and is appropriately drilled and tapped to receive the motor mounting screws. In approximately its middle, drive module body 41 has a transverse arcuate window 43 cut into one side to provide clearance for the tubing 10. Square outer flange 44 has a central vent hole and is mounted to the transverse second end of drive module body 41 by a comating pattern of drilled and tapped holes at the corners by outer flange screws 49. An internal transverse shoulder 45 is located on each side of window 43 in the bore of drive module body 41. A needle bearing 46 is pressed into the bore of drive module body 41 from each end to support drive roller 60 for loads normal to its axis. A bearing retainer 47, mounted outboard of each bearing 46, consists of short cylinder with a stepped through bore to clear roller 60. Bearing retainer 47 slip fits into the bore of drive module body 41 with its counterbore facing inwardly and its inward end abutting the outer end of bearing 46. A round tubular spacer sleeve is located outboard of each bearing retainer 47 within the bore of drive module body 41 to hold bearing retainer 47 in place. The spacer sleeve 48 on the motor end is retained by the drive motor 50, while the spacer sleeve on the opposed end of drive module body 41 is retained by outer flange 44.

Drive motor 50 is a small reversible hydraulic motor of gear motor or gerotor construction and with a splined output shaft 51. Drive motor 50 is mounted to motor mount flange 42 of drive module body 41 by motor mount screws 52. Hydraulic ports 53 handle the pressurized fluid supply for drive motor 50. Drive roller 60 has a central arcuate drive face 61 with a first journal 62 and second journal 63 at its opposed ends for support in drive module 40 by needle bearings 46. Splined socket 64 is mounted on the outer end of first journal 62 for engagement with output shaft 51 of drive motor 50 so that the roller 60 may be driven in either direction of rotation. The arcuate drive face 61 of drive roller 60 is configured to contact the round tubing 10 over an arc length of approximately 100°, so that the tubing will be well supported on all sides by the four rollers in a set of two adjacent opposed pairs of drive modules 40, as shown in FIG. 4.

Figure 7:
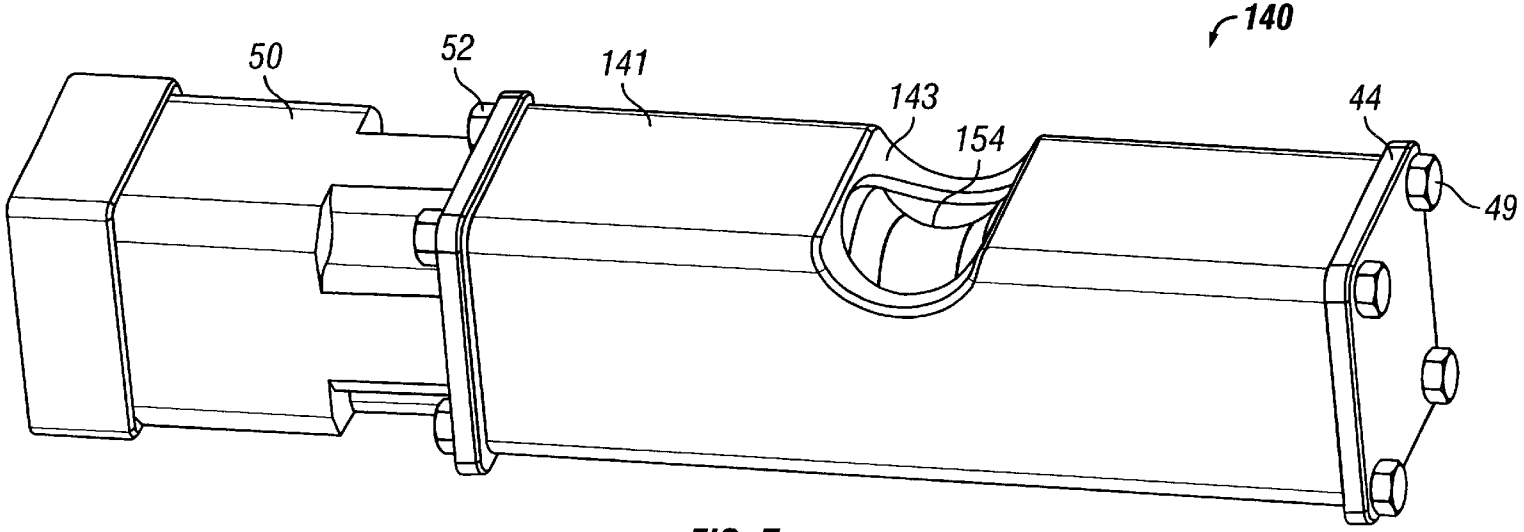
FIG. 7 shows an oblique view of a first type of multi-tired drive module utilized in the injector, the straightener, and the arc corrector of this invention.
Figure 8:
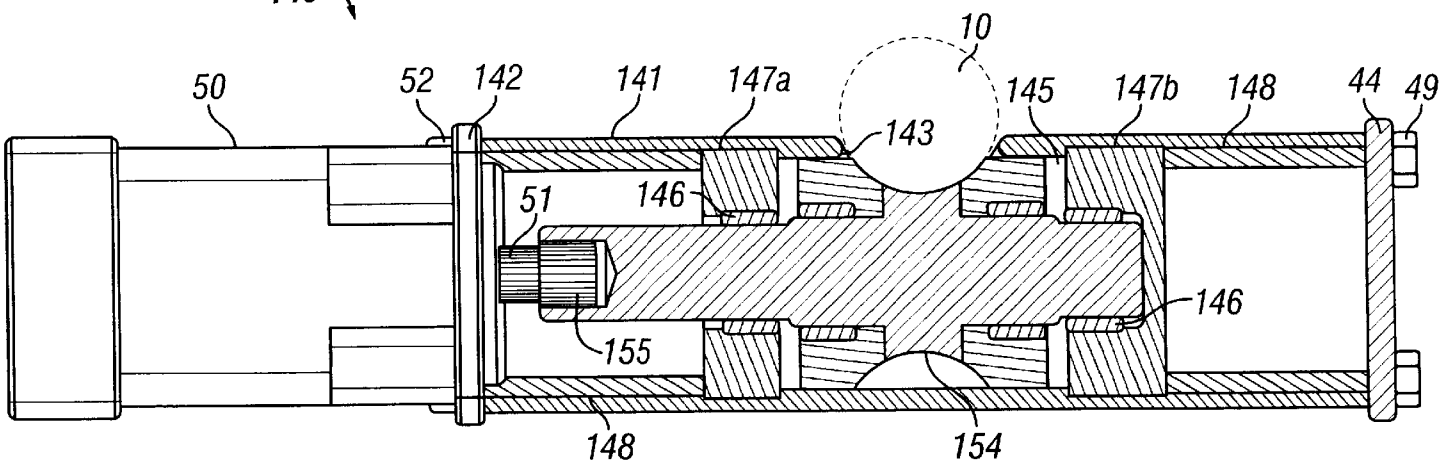
FIG. 8 shows a longitudinal cross-section of the same type of drive module shown in FIG. 7, but incorporating a three-element drive roller.

FIGS. 7 and 8 show a drive module 141 which utilizes an improved multi-tire roller 154 described in U.S. patent application Ser. No. 09/977,784, filed Oct. 15, 2001 and entitled "Rollers for Coiled Tubing Injectors" which is hereby incorporated herein by reference. The roller 154 has separate, free-wheeling tires symmetrically positioned about the central arcuately faced roller, wherein the free-wheeling tires also have similarly arcuately faced rollers which have the same radius and centers for their arcs when positioned about the central roller. The arcs of the central roller and the free-wheeling tires combine to provide a much larger arc of pipe contact and support than possible with a monolithic roller 60. Referring to FIG. 8, drive module 140 consists of a square cross-section drive module body 141, a hydraulic drive motor 50, and drive roller 154, along with associated hardware. Drive module body 141 has a through bore with two internal transverse shoulders and square motor mount flange face 142 at its first end. The flange face of motor mount flange 142 is configured to mount motor 50 and is appropriately drilled and tapped to receive the motor mounting screws. In approximately its middle, drive module body 141 has a transverse arcuate window 143 cut into one side to provide clearance for the tubing 10. Square outer flange 44 has at central vent hole and is mounted to the transverse second end of drive module body 141 by a comating pattern of drilled and tapped holes at the corners by outer flange screws 49. An internal transverse shoulder 145 is located on each side of window 143 in the bore of drive module body 141. A needle bearing 146 is pressed into the bore of each of bearing retainers 147*a,b* to support drive roller 154 from each end for loads normal to its rotational axis. Bearing retainers 147*a,b,* mounted outboard of roller 154 on each end, consists of short cylinders with a stepped through bore to clear roller 60. Bearing retainer 147*a* has its shaft clearance hole passing completely through the cylinder, while bearing retainer 147*b* has another smaller counterbore so that it is not a blind hole. Bearing retainers 147*a,b* slip fit into the bore of drive module body 141 with their counterbores facing inwardly and their inward bearing counterbore ends abutting the outer ends of bearings 146. A round tubular spacer sleeve 148 is located outboard of each bearing retainer 147*a,b* within the bore of drive module body 141 to hold the bearing retainers in place. The spacer sleeve 148 on the motor end is retained by the drive motor 50, while the spacer sleeve on the opposed end of drive module body 41 is retained by outer flange 44. As before, drive motor 50 is a small reversible hydraulic motor and is mounted to motor mount flange 142 of drive module body 141 by motor mount screws 52. Motor 50 is engaged to drive roller 154 by means of internal spline 155 of the roller engaging with the splined output shaft of the motor.

Referring to FIGS. 9 through 12, a third embodiment of single-tired drive module 240 is shown, although it readily may be understood that the module could likewise be used with the improved multi-tired roller 154 which was used in the second drive module embodiment 140. Any of the three drive module embodiments 40, 140, or 240 can be used interchangeably in the injector unit 2 or any of the other devices which utilize the drive modules of this invention. The primary advantage of drive module 240 is that the drive rollers can be changed for a different tubing size or repair by extracting the roller with its bearings while the body and its drive motor 250 remain in place.

Drive module 240 consists of a square cross-section drive module body 241. a hydraulic drive motor 250, and drive roller 60, along with associated hardware. Drive module body 241 has a first rectangular C-channel type cross-section open on the tubing side. The C-channel is cut from rectangular or square structural tubing. Centrally located transverse arcuate cutouts 243 provide clearance for the passage of tubing by the module. In the interior cavity of the rectangular channel of body 241 are positioned two mirror-image welded-in internal shoulders 248 transverse to the longitudinal axis of body 241. Integral square motor mount flange 242 is located at the first end of body 241. The flange face of motor mount flange 242 is configured to mount motor 250 and is appropriately drilled and tapped to receive the motor mounting screws 252. The middle side of the channel of body 241 has a centrally located drilled and tapped hole 245 near the end opposite flange 242. Reinforcing plate 255 is welded onto the back side of the C-channel of module body 241 opposite the arcuate cutouts 243 in order to better distribute the biasing loads from the squeeze cylinder 29 for the module. Square outer flange 244 has a rectangular central access hole and has mounted by welding on its inner face a second rectangular C-channel section which is able to closely nest within the channel section of body 241. A centrally positioned clearance hole for a clamp screw 249 is coaxial with hole 245 in body 241 when the module 240 is assembled into place. This clamp screw clearance hole is located on the middle of the three faces of the second channel of flange 244. A handle for extracting outer flange 244 is mounted on the outside face of the flange opposite the second C-channel. A needle bearing 246 is pressed into the central counterbore of each of the identical rectangular prism bearing retainers 247 to journal and support drive roller 60 for loads normal to its axis. The bearing mount counterbores in the bearing retainers are coaxial with a smaller diameter through hole in order to clear roller 60. When assembled in place with drive roller 60, each bearing retainer 247 closely slip fits into the interior of the C-channel of drive module body 241 with its counterbore facing inwardly toward the middle of the of the body 241. The bearing mount 247 on the motor side abuts the transverse shoulders 248 of body 241, while the other bearing mount is abutted by the inner end of the C-channel of outer flange 244, as seen in section in FIG. 12. The bearing mounts 247 are loosely retained within the C-channel of body 241 by engagement of the drive wheel 60 with the output shaft of motor 250, but when the drive module 240 is mounted and engages tubing, the bearing mounts are tightly pressed into and retained by body 241. Clamp screw 249, which is accessed through the central access hole of outer flange 244, is engaged into the screw clearance hole of flange 244 and the tapped hole 245 and serves to secure the outer flange to body 241. Split shaft clamp collar 256 is clamped on the driven shaftend of drive roller 60 adjacent the bearing retainer 247 on the motor side of the roller so that the entire assembly can be extracted in one piece. The idler end of drive roller 60 may be tapped in order to ease the removal of the roller and its supporting bearings.

Figure 9:
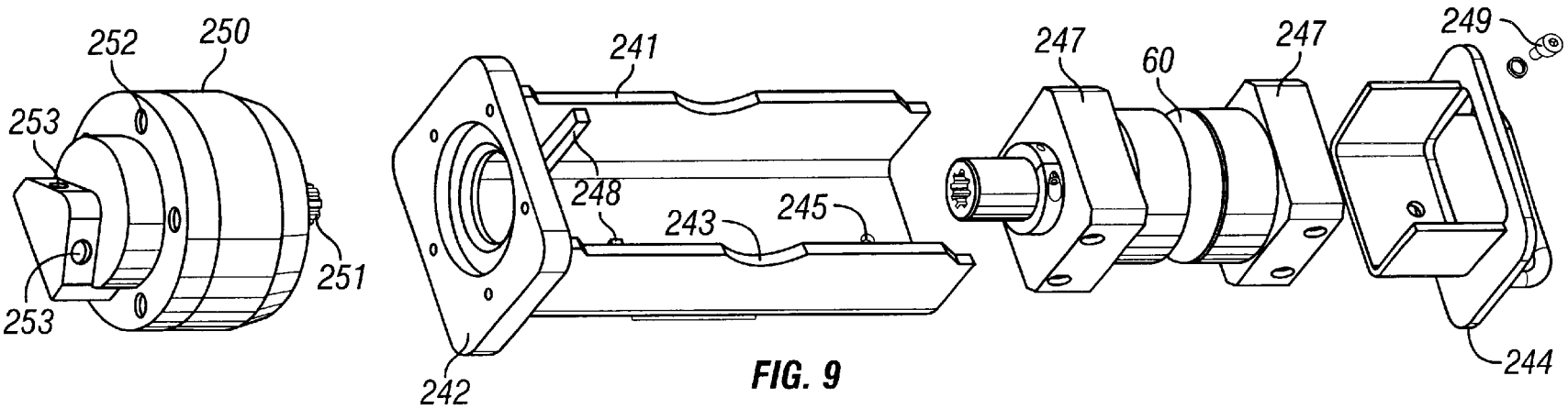
FIG. 9 shows an exploded oblique view of an alternative arrangement of the drive module used in this invention.
Figure 12:
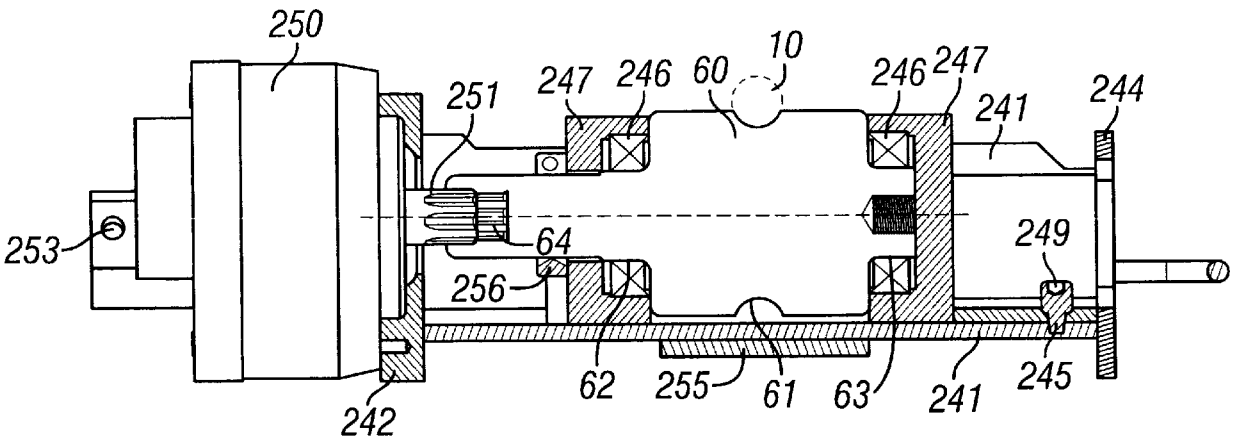
FIG. 12 is a longitudinal cross-sectional view of the alternative arrangement of the drive module taken along line 12—12 of FIG. 11.
Figure 10:
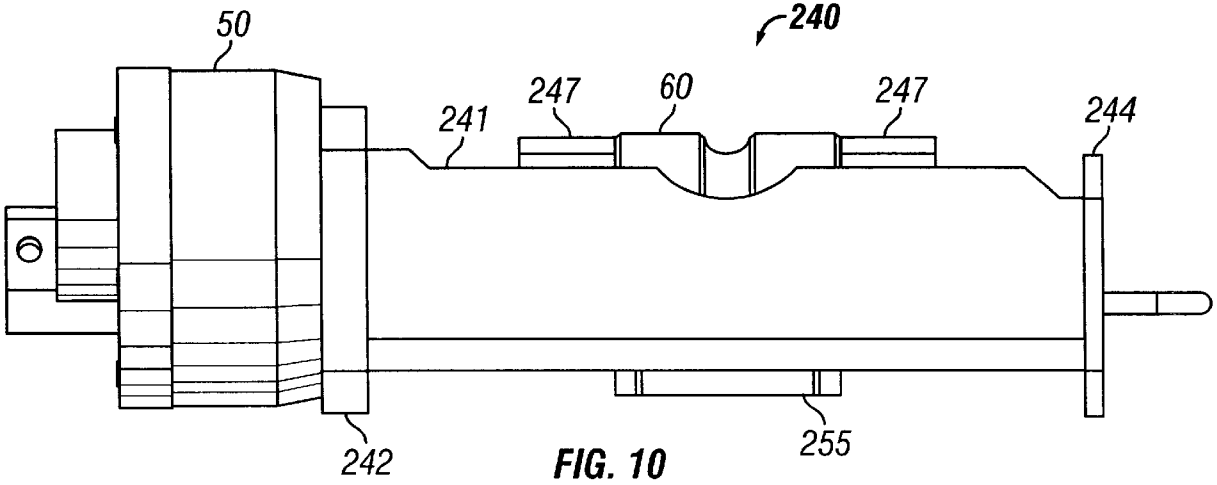
FIG. 10 shows a side profile view of the alternative arrangement of the drive module of FIG. 9.
Figure 11:
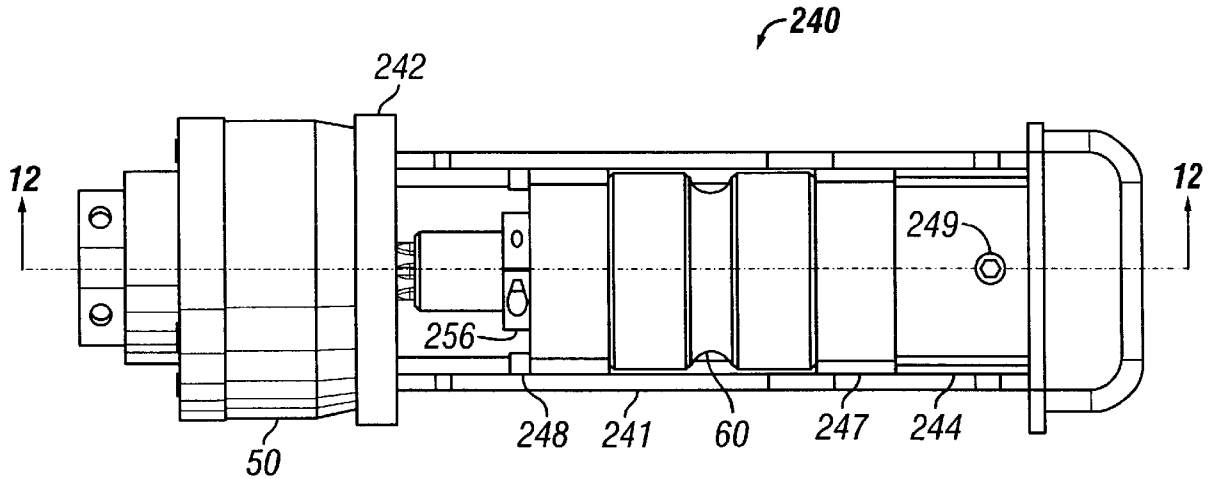
FIG. 11 shows a plan view of the alternative arrangement of the drive module from a view direction normal to that of FIG. 10.

Drive motor 250, shown in FIG. 9, is a small reversible hydraulic motor of gear motor or gerotor construction and with a splined output shaft 251. Drive motor 250 is mounted to motor mount flange 242 of drive module body 241 by motor mount screws 252. Hydraulic ports 253 handle the pressurized fluid supply for drive motor 250. Drive roller 60 has a central arcuate drive face 61 with a first journal 62 and second journal 63 at its opposed ends for support in drive module 240 by needle bearings 246. Splined socket 64 is mounted on the outer end of first journal 62 for engagement with output shaft 251 of drive motor 250 so that the roller 60 may be driven in either direction of rotation. The arcuate drive face 61 of drive roller 60 is configured to contact the round tubing 10 over an arc length of approximately 100°, so that the tubing will be well supported on all sides by the four rollers in a set of two adjacent opposed pairs of drive modules 40, as may be seen from FIG. 12 and FIG. 5.

Figure 13:
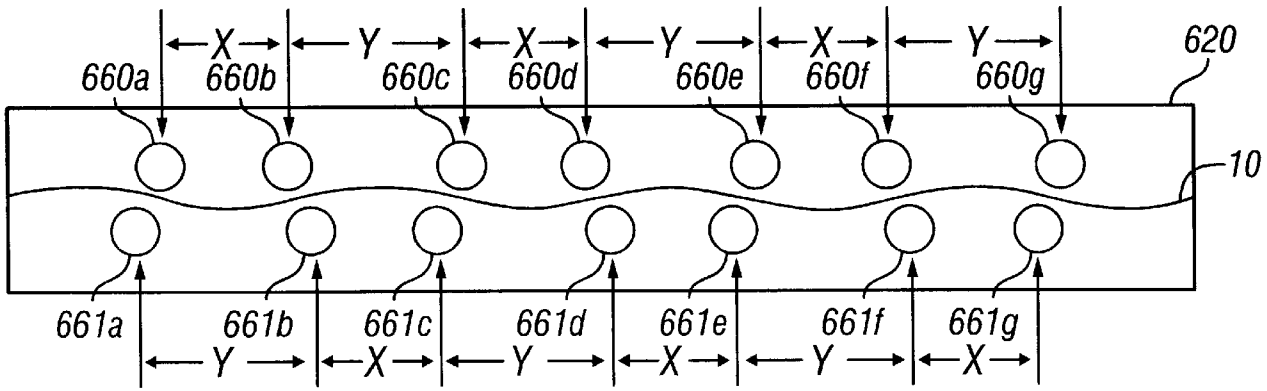
FIG. 13 is a schematic view showing a first alternative to the directly opposed arrangement of the drive modules of the traction device of this invention.

In the embodiment of the traction drive 12 shown in FIGS. 1–5, the drive modules 40, 140, or 240 have all been positioned in directly opposed pairs. This arrangement works well to avoid tube ovaling under the high lateral bias loads required to achieve high pulling capability with the traction drive. However, alternative relative positionings of the drive modules on opposite sides of the tubing are possible. FIG. 13 schematically shows a second traction drive embodiment 620 in which the drive module rollers 660*a–g* and 661*a–g* are offset from a directly opposed alignment. For traction drive 620, adjacent drive module roller pairs 660*a* and 660*b*, 660*c* and 660*d*, 660*e* and 660*f*, 661*b* and 661*c*, 661*d* and 661*e*, and 661*f* and 661*g* are all spaced distance X apart. The other adjacent drive module roller pairs 660*b* and 660*c*, 660*d* and 660*e*, 660*f* and 660*g*, 661*a* and 661*b*, 661*c* and 661*d*, and 661*e* and 661*f* are all spaced distance Y apart, where distance Y is greater than distance X. With the same bias forces from the squeeze cylinders 29, the tubing will assume a distorted, sinuous shape as shown in FIG. 13. In the case of this second traction drive embodiment 620 shown in FIG. 13, the mounting holes in the body 21 are appropriately offset axially to achieve the desired sinuous tubing path. It has been found experimentally that higher tractive loads can be developed for the same squeeze cylinder bias force with a sinuous track such as that shown in FIG. 13.

Figure 14:
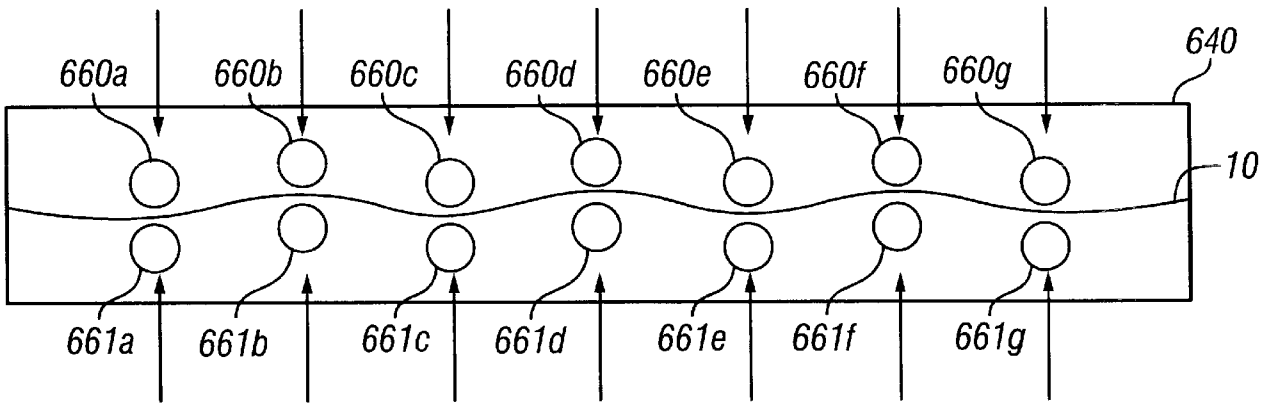
FIG. 14 is a schematic view showing a second alternative to the opposed arrangement of the drive modules of the traction device of this invention.

An alternative third traction drive embodiment 640, shown schematically in FIG. 14, maintains the opposed drive module positions of traction drive 12 of the first embodiment, but achieves sinuosity of the tubing passing through the traction drive by an alternate means. Either mechanically or, preferably, hydraulically, the opposed drive module roller pairs 660*a* and 661*a*, 660*b* and 661*b*, 660*c* and 661*c*, 660*d* and 661*d*, 660*e* and 661*e*, 660*f* and 661*f*, and 660*g* and 661*g* are alternately offset in different directions from the longitudinal centerline path through the traction drive. This is achieved mechanically by forcing one roller of each pair to a desired fixed offset position and then biasing the opposed roller against it. This is achieved hydraulically by applying an uniformly higher biasing force by means of the squeeze cylinders 29 to the drive module rollers which are to be displaced past the centerline of traction drive 640 and an uniformly lower biasing force to the drive module rollers which are to not travel fully to the centerline.

Figure 15:
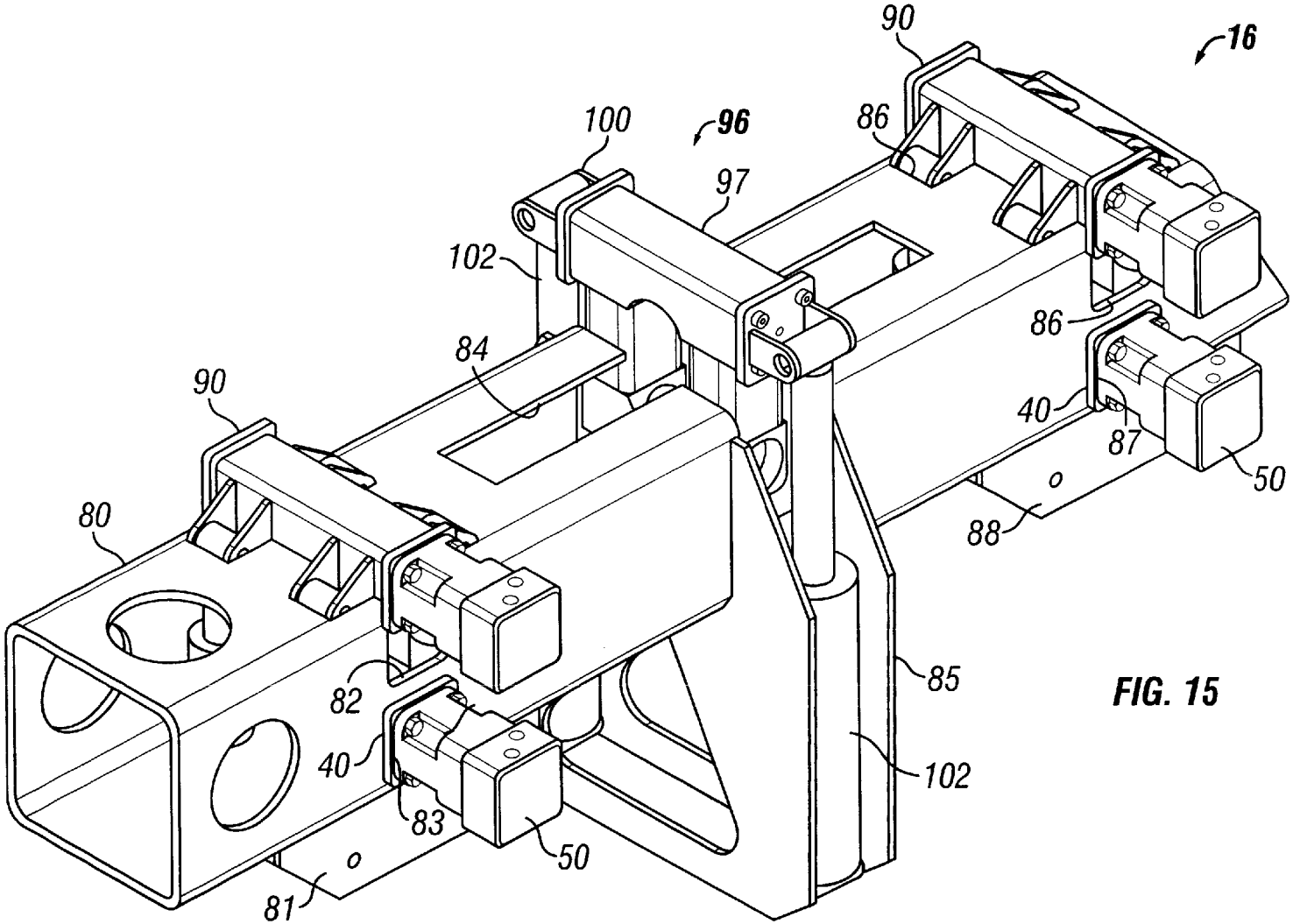
FIG. 15 shows an oblique view of the selectably operable integral tubing curvature adjuster which is used with the injector of this invention.
Figure 16:
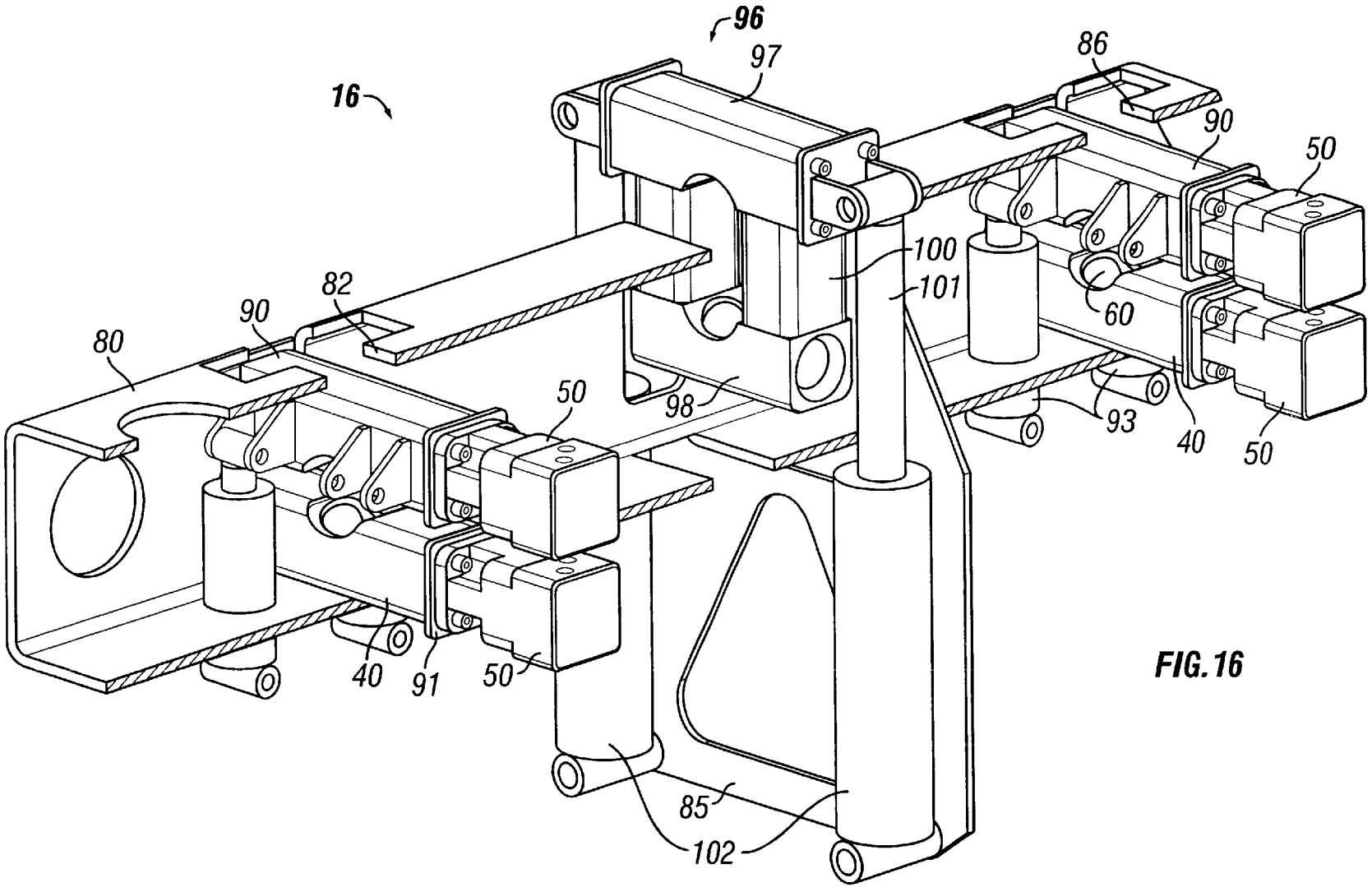
FIG. 16 is an oblique partial longitudinal cross-section of the tubing curvature adjuster in position for bending the tubing in a first direction.

The tubing injector 2, shown in FIG. 2, has an optional tubing straightener 16 integrated into the tubing injector 2. The tubing straightener 16 is a special adaptation of a three-wheel straightener configured and improved for the special requirements of coiled tubing work. FIG. 15 shows an oblique view of the tubing straightener 16, and FIG. 16 shows a similar view, but with a portion of the housing cut away for clarity in showing the internal components. Housing 80 is shown with its lower end to be attached by welding to the top of slip unit 14, but other suitable means such as a flange or mounting clips could be used. Housing 80 is composed basically of a piece of square structural tubing with attached brackets and ports and windows. The features of housing 80 are, from the lower end, first back bracket 81, lower moveable drive module window 82, lower drive module ports 83, middle straightener window 84, straightener cylinder bracket 85, upper moveable drive module window 86, upper drive module ports 87 and second back bracket 88. Circular lightening holes are cut in the sides of the lower end of housing 80 for inspection purposes, but otherwise have no structural function. Back brackets 81 and 88 are mounted on the back side of housing 80 which is closest to storage reel 8; each is made of two identical plates normal to the back wall of housing 80 and mirrored about the centerline of the back side on which they are mounted. Two pairs of symmetrically placed coaxial cylinder mount holes are drilled in bracket 81 for mounting the cylinder end of actuator cylinders 93.

Lower moveable drive module window 82 is a basically rectangular transverse cutout parallel to the back wall of housing 80 through both the two lateral sides which are adjacent the back side and the front side of housing 80. Window 82 extends from close to the center plane between the front and back walls of housing 80 to the front wall. Additionally, four symmetrically placed clearance notches above and below and intersecting the window 82 are cut on the front wall of housing 80 to accommodate drive module cylinder mount brackets 91 on the bracketed drive module 90 positioned in window 82. On the back wall of housing 80 transversely opposed to the four cylinder bracket clearance notches in window 82 are four corresponding cylinder clearance holes to accommodate the four actuator cylinders 93 for the bracketed drive module 90. Two lower drive module ports 83, similar to the drive module ports 26*a,b* shown in FIG. 4, are transversely opposed square openings in the lateral sides of housing 80. Lower drive module ports 83 are located on the lateral sides of housing 80 off the center plane toward the back wall and opposed to window 82. Lower drive module ports 83 mount one of the same drive modules 40 which are used in the traction drive 12. The drive module 40 is oriented so that its drive roller 60 will contact the coiled tubing which is concentric with the longitudinal axis of housing 80 at the location of the lower drive module windows 83.

Middle straightener window 84 is a basically rectangular transverse cutout parallel to the back wall of housing 80 through both the two lateral sides which are adjacent the back wall and the front wall of housing 80. An elongated longitudinal slot cut centrally in the front wall of housing 80 centrally intersects window 84. Straightener cylinder bracket 85 consists of two identical symmetrical plate elements projecting normal to the back wall and welded thereto. The two plates are symmetrically mounted above and below middle straightener window 84. For stability, bracket 85 is extended onto the sides of housing 80. Outboard of the central lightening holes in bracket 85 and spaced away from the centerline of bracket 85 and offset from the back wall of housing 80 are cylinder mount holes for attaching the shifting cylinders 102 for straightener wheel frame 96.

Upper moveable drive module window 86 and upper drive module ports 87 are respectively identical to lower moveable drive module window 82 and lower drive module ports 83. Similarly, second back bracket 88 is identical to first back bracket 81. As shown in FIGS. 15–21, middle straightener window 84 and straightener cylinder bracket 85 are mounted equispaced from and between lower drive module ports 83 and upper drive module ports 87 but this arrangement may be varied by design from that configuration in order to alter the support roller loadings or geometry of the tubing path. Upper drive module ports 87 mount a drive module 40 of the same type as used in the traction drive 12.

Bracketed drive module 90 consists of a drive module 40 identical to that used in traction drive 12, but with the addition of two sets of two identical drive module cylinder mount brackets 91 made from approximately triangular plate on each lateral wall of the drive module body 41. The brackets are symmetrical about arcuate window 43 in drive module body 41 in the axial direction. Each set of two plates is spaced apart and provided with coaxial pin holes to admit the rod end of an actuator cylinder 93, which is pin-mounted to the bracket plates. The four hydraulic actuator cylinders 93 for the bracketed drive module 90 have their cylinder ends pin-mounted to the pin holes first back bracket 81. Actuator cylinders 93 are used to urge bracketed drive module 90 toward the drive module 40 mounted in lower drive module ports 83 so that coiled tubing 10 is gripped therebetween so that it may be driven.

Figure 17:
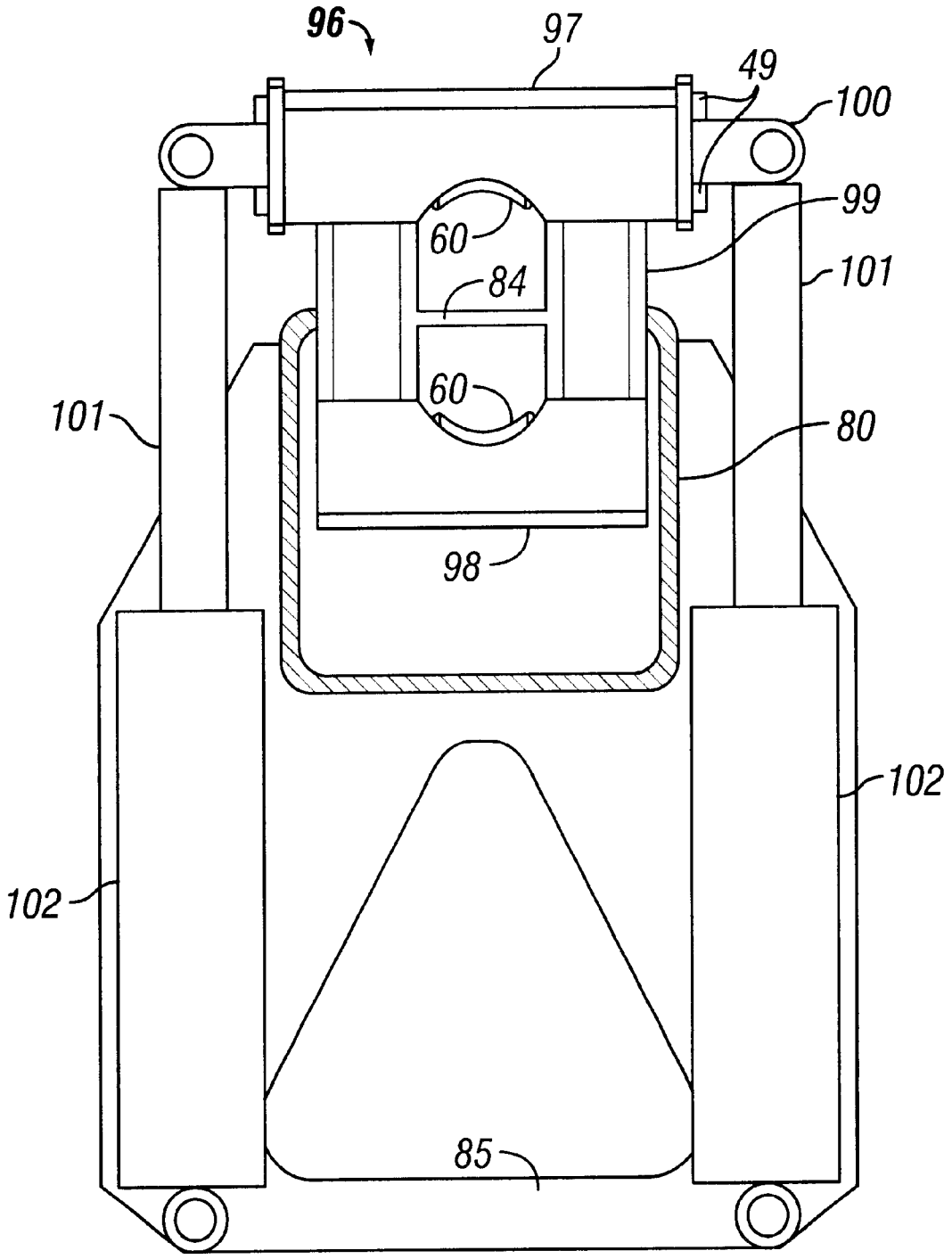
FIG. 17 is a transverse cross-sectional view of the variable-position central roller mount of the tubing curvature adjuster.
Figure 18:
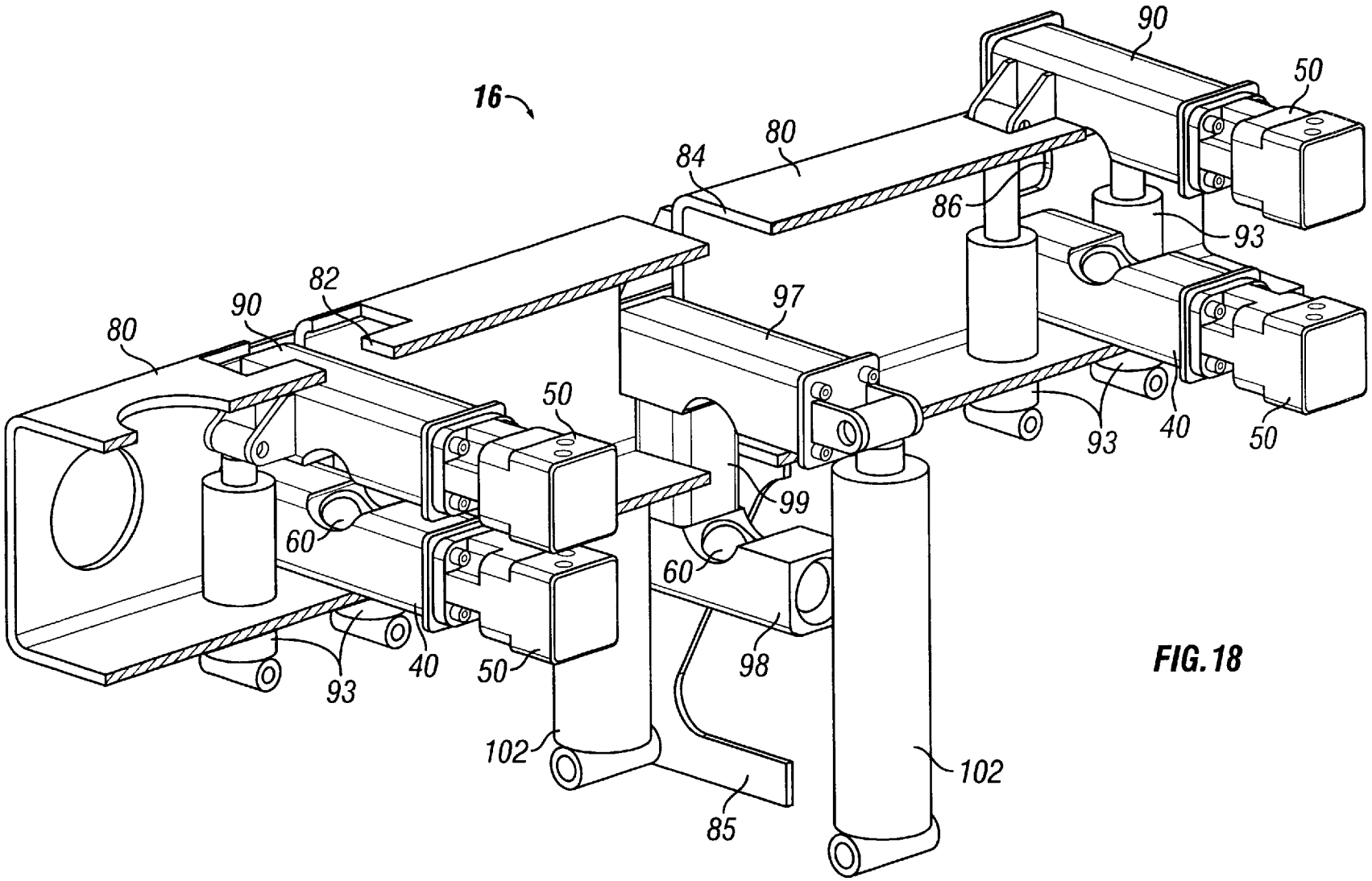
FIG. 18 is an oblique partial longitudinal cross-section of the tubing curvature adjuster corresponding to that of FIG. 16, but with the unit positioned for bending the tubing in a second direction.

Referring to FIG. 17, straightener wheel frame 96 has a hollow approximately rectangular shape with a front roller housing 97, a back roller housing 98, and two identical tie tubes 99 welded to and interconnecting the front and back roller housings 97 and 98, respectively. Front roller housing 97 is configured similarly to drive module body 41 in that it is a bar having a square cross-section. Housing 97 has a longitudinal central through bore with internal transverse shoulders adjacent a central arcuate window for exposure of a roller 60 of the type used in the drive modules 40 of the traction drive 12. The roller 60 is supported on both sides on needle bearings 46 which are held in place by bearing retainers 47, again similarly to the roller and bearings of the drive modules 40. The transverse ends of front roller housing 97 are drilled and tapped on the corners. Back roller housing 98 is similar to that of front roller housing 97, but it is shorter and is either provided with outer flanges 44 mounted by outer flange screws 49 screwed into drilled and tapped holes in the corners of its transverse outer ends or, as shown, it may be used without end flanges if its bearing retainers 47 are pressed into its longitudinal bores. Cylinder mount ears 100 consist of square flat base plates with symmetrically offset identical ear plates normal to the base plate and having coaxial pin holes. The cylinder mount ear base plates are drilled on the corners to permit mounting them by outer flange screws 49 to the drilled and tapped holes on the transverse ends of front roller housing 97. Two shifting cylinders 102 are connected on their cylinder ends to the corner pin holes of straightener cylinder bracket 85 and by the end eyes of shifting cylinder rods 101 to the pin holes of cylinder mount ears 100. Both the straightener wheel frame 96 and the cylinders 102 are mounted between the plates of the straightener cylinder bracket. Straightener cylinder bracket 96 intrudes into the central cavity of housing 81 through middle straightener window 84.

Figure 22A:
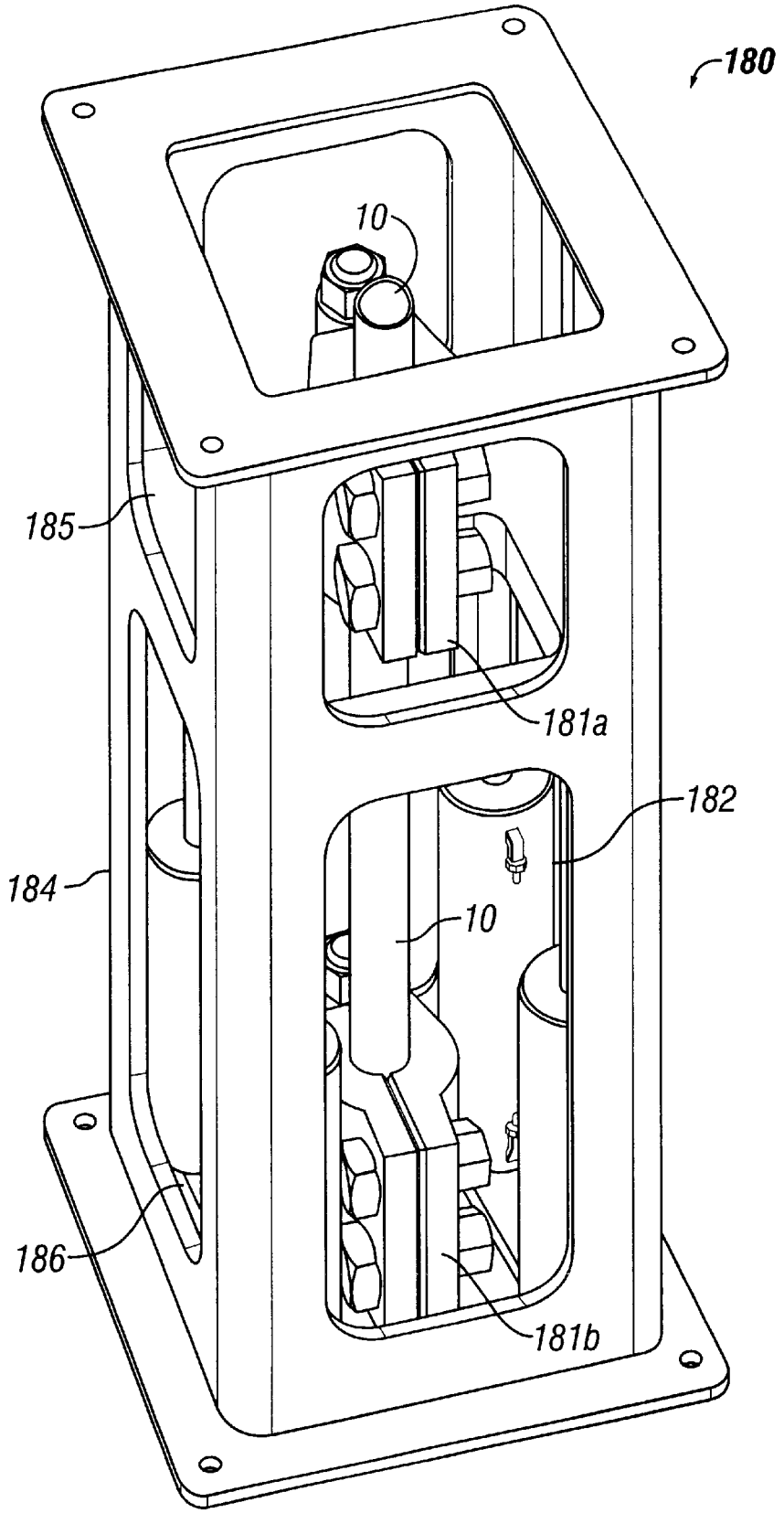
FIG. 22A is an oblique view of the integral thrust enhancement device attached to the lower end of the injector of this invention.
Figure 22B:
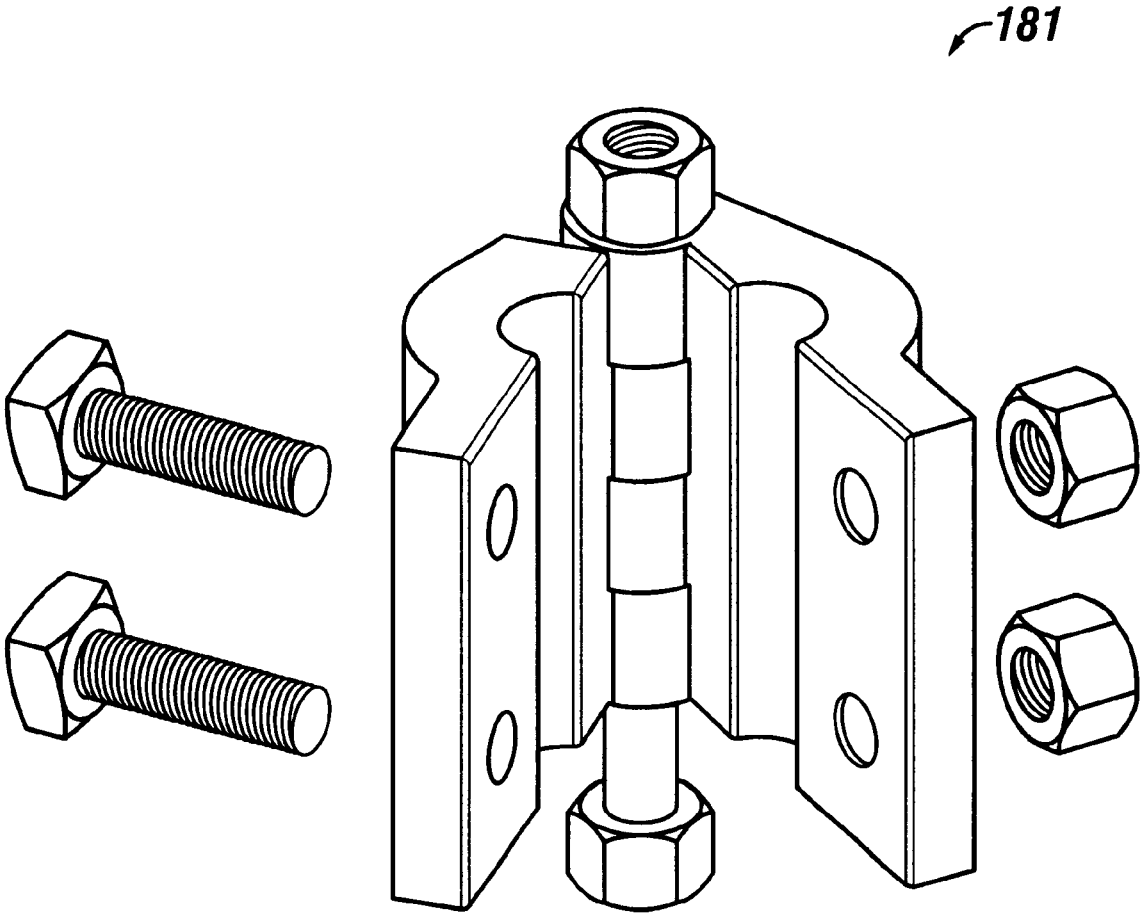
FIG. 22B is an exploded view of the tubing gripping device used in the integral thrust enhancement device shown in FIG. 22A.

FIGS. 22A and 22B show the thrust enhancement device 180 which may optionally be used with this invention. This device is disclosed in U.S. patent application Ser. No. 09/966,444, filed Sep. 28, 2001, and entitled "Thrust Enhancement Device for Coiled Tubing Injectors" which is hereby incorporated herein by reference. While this device is not shown with the injector 2 of the first injector embodiment, it could readily by positioned either between the traction unit 20 and the tubing straightener 16 or located below the traction drive 12 and the adapter spool 19. The second embodiment 280 of the injector does have a thrust enhancement device 180 mounted below its traction unit 12. The thrust enhancement device 180 has two either manually engaged or remotely engaged tubing grippers which clamp around the circumference of the tubing. The manually engaged tubing gripper 181 is a common type of oilfield device which grips by means of hand tightening bolts with nuts and is shown in more detail in FIG. 22B. The thrust enhancement device 180, as illustrated in FIG. 22A, has a square tubular body 184 with window cutouts for operator access to the stationary tubing gripper 181*a* and the moving tubing gripper 181*b*. Body 184 has upper and lower transverse mounting flanges by which it may be connected in axially aligned series with the traction drive 12 and the adapter spool 19 or above the injector unit 2. First transverse bulkhead 185 is welded to body 184 and located towards the middle from the upper end of body 184 supports stationary tubing gripper 181*a*. Second transverse bulkhead 186 is axially reciprocable in the lower end of body 184 and serves to support the cylinder end of an array of double-acting hydraulic thrust cylinders 182 and moving tubing gripper 181*b*. The rod end of the array of thrust cylinders 182 is mounted to the first transverse bulkhead 185.

Figure 23:
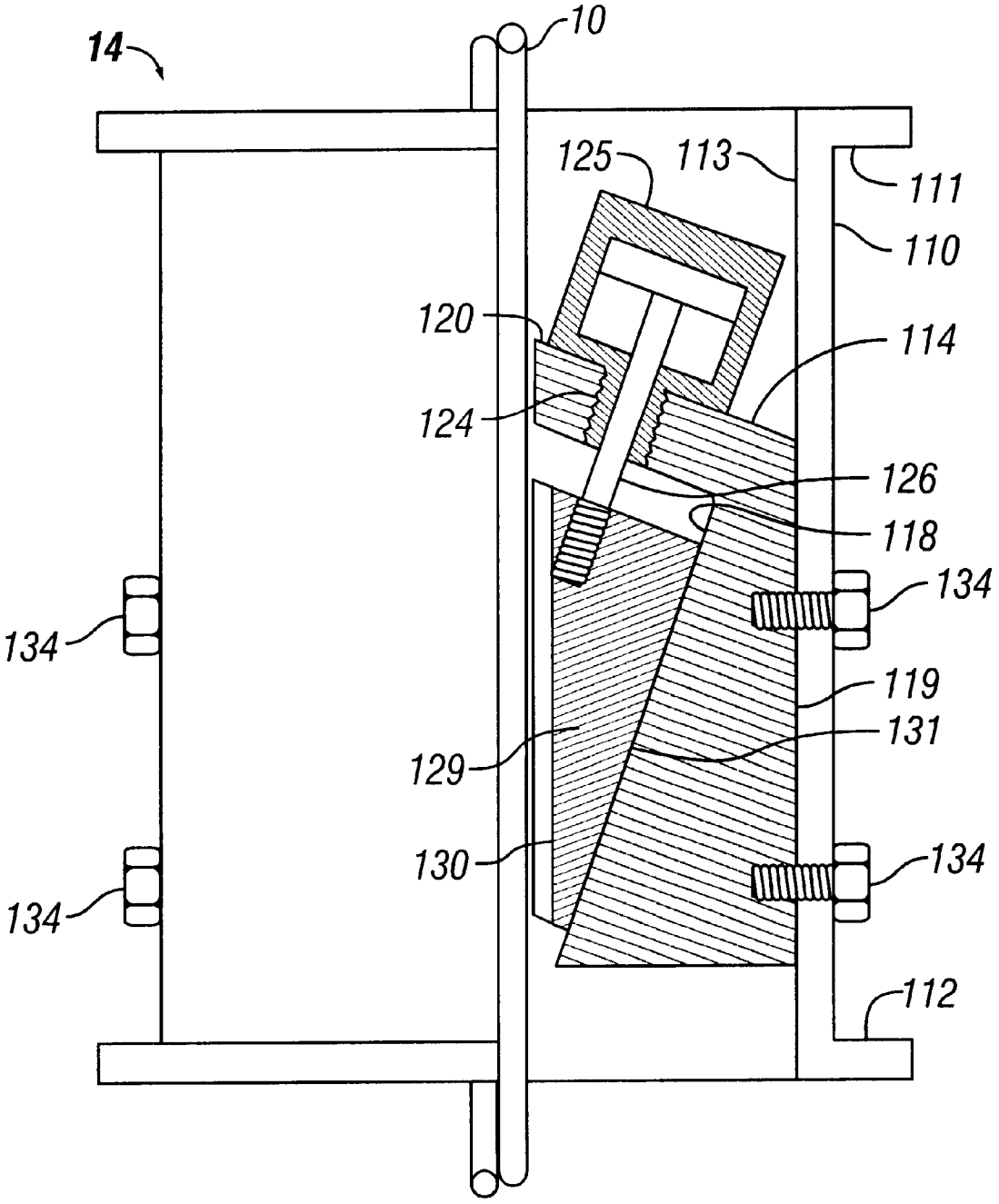
FIG. 23 is a longitudinal quarter-sectional view of the slip unit of the injector.

Slip unit 14, shown in quarter section in FIG. 23, is housed in a slip body 110 made of square structural tubing and having similar transverse top 111 and bottom flanges 112 by which the slip unit is mounted to the lower end of tubing straightener 16 and the upper end of traction drive 12, respectively. In the interior of slip body 110 and mounted on opposite interior walls 113 are two identical slip wedge assemblies. Slip track 114 is cut from a section of rectangular bar stock and serves to mount the actual slip wedge 129 and the actuator for the slip. Slip track 114 has a planar guide 118 which has its face inclined at a self-releasing angle of approximately 15° to the central longitudinal axis of slip body 110. Back face 119 is planar and rests against inner wall 113. Cylinder mount projection 120 extends inwardly perpendicular to inclined guide 118 at the upper end of slip track 114. Internally threaded cylinder mount hole 124 is located centrally on and perpendicular to cylinder mount projection 120. Hydraulic slip cylinder 125 is double acting with a nose mount that is threaded into cylinder mount hole 124. Slip cylinder rod 126 is threaded into the drilled and tapped hole in the upper face of slip 129. Slip 129 has an arcuate gripping face 130 which is conformed to the size of tubing 10 and covers an arc of somewhat less than 180°. The sliding face 131 of slip 129 is planar and is inclined to the arcuate gripping face axis by the same angle which planar guide 118 is inclined to back face 119 of slip track 114. Multiple keeper screws 134 pass through holes in slip body 110 and are threaded into corresponding drilled and tapped holes in the back face 119 of slip track 114 to retain the slip assembly elements within the slip body.

Figure 24:
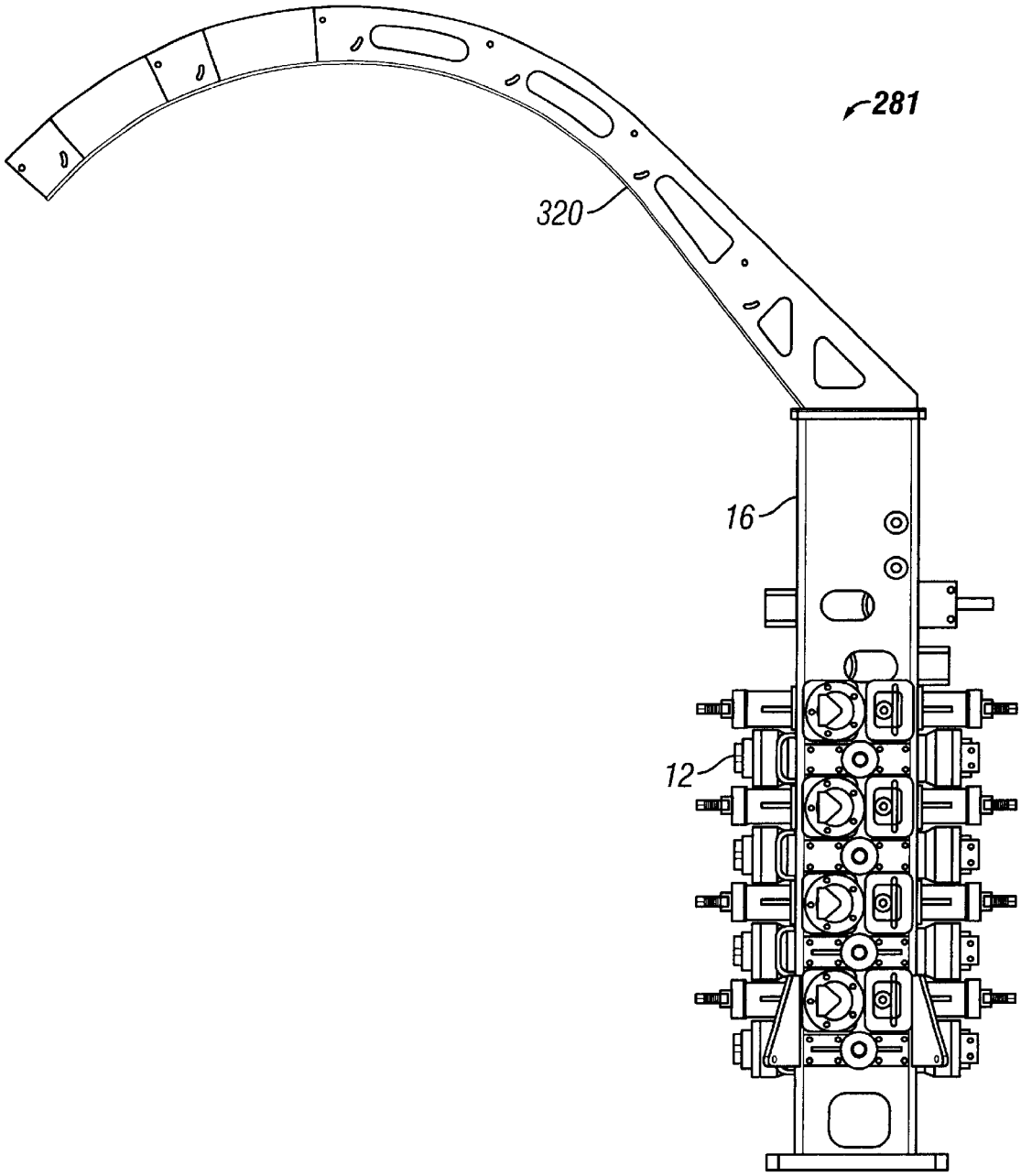
FIG. 24 is a side profile view of the injector unit of this invention with the gooseneck device attached.
Figure 25:
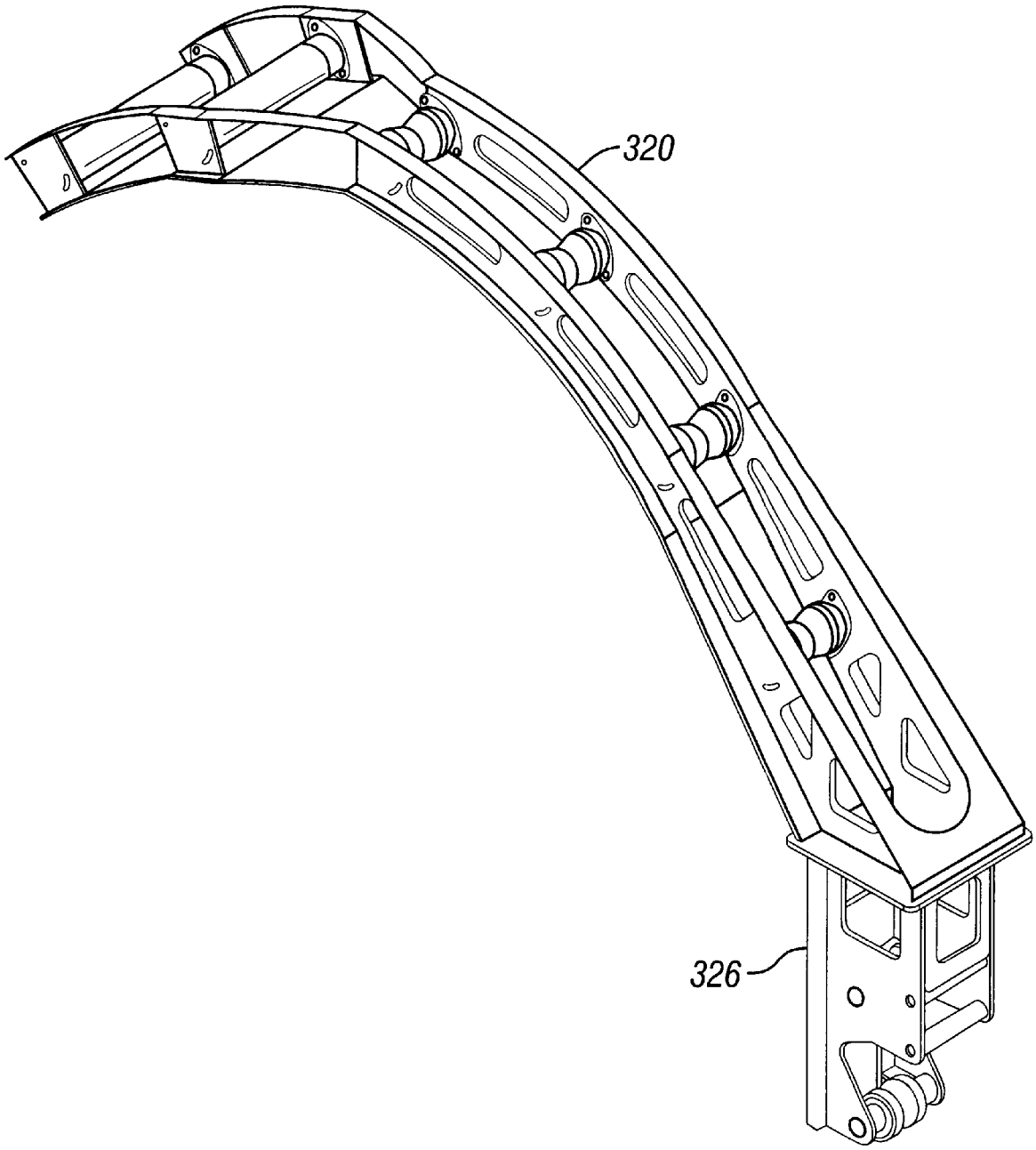
FIG. 25 is an oblique view of the gooseneck device of this invention.

There are numerous potential configurations of the tubing injector of the present invention. For example, FIG. 24 shows a profile view of another embodiment of injector unit 281 which is a slight modification from the injector units 2 or 280. For this injector, the traction drive 12 is integrated with the curve adjuster 16 and a gooseneck 320. The gooseneck 320 is of the conventional design familiar to the coiled tubing industry and shown in more detail in FIG. 25, but is mounted by stabbing projection 326 into the top of the housing of the tubing straightener 16. As can be seen in the drawings, the gooseneck mounts an array of support rollers which serve to define the curvature of the tubing 10 between the injector unit and the reel 8. Note that the gooseneck 320 is representative of the other goosenecks 320 which are used in the various rig arrangements of this patent.

The operation of the tubing injector 2 or 280 is similar in many respects to that of a conventional coiled tubing injector in that it both inserts and withdraws coiled tubing from a well. However, certain critical differences exist between this device and both track-type and wheel-type injectors, as will be described below.

A primary difference in the tubing injector 2 or 280 of the present invention from the conventional coiled tubing injector is the use of the multi-tired rollers in the drive modules to provide better lateral support for the tubing. The result is that tubing is less likely to become severely ovaled in the injector of the present invention. The simple change out of rollers or replacement of bearings for the drive modules of the third drive module embodiment permits considerable savings in time and expense over competitive designs of injector. Otherwise, the operation of the three types of drive module, 40, 140, and 240, is identical as far as general handling and the maintenance of tubing trajectory and the application of thrust to the tubing are concerned.

Figure 19:
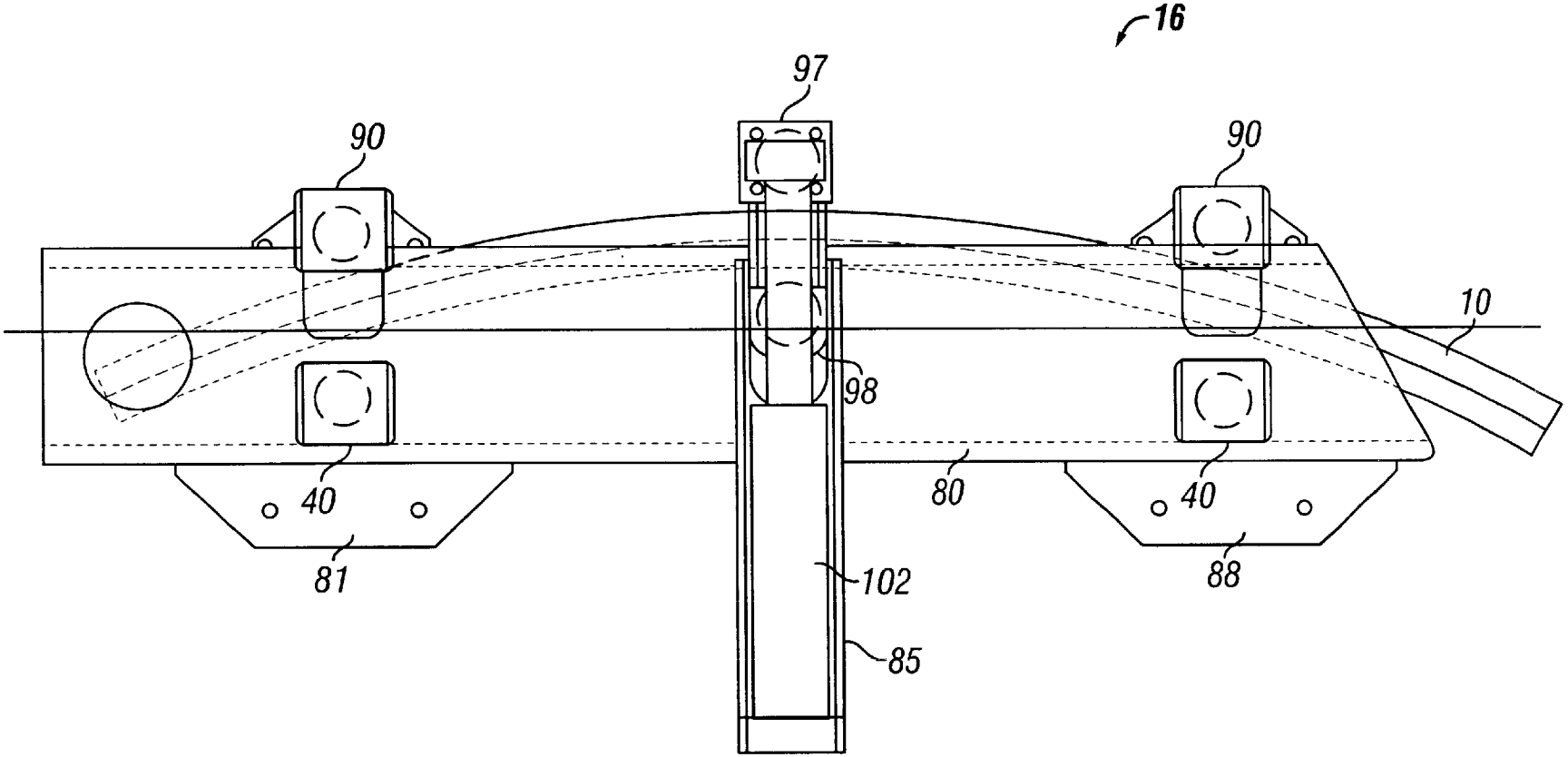
FIG. 19 is a side profile view of the tubing curvature adjuster showing the unit in its open position for passing tubing without imparting bending.

In order to feed tubing into the unit during initial loading, the squeeze cylinders 29 of the traction drive 12 are manipulated by either pressure or retractor screws and the actuator cylinders 93 for the bracketed drive modules 90 of the curvature adjuster 16 are pressurized to respectively permit moving their respective rollers 60 away from the centerline path for the tubing 10. In the case of squeeze cylinders 29, the rods 30 are retracted so that the drive modules 40 can easily be displaced laterally within their lower 26*a,b* and upper 27*a,b* drive module ports to permit tubing passage. In the case of actuator. cylinders 93, the rods are fully extended so that the tubing can readily be passed between the rollers 60 of the static drive modules 40 mounted in lower drive module ports 83 and 87 and their opposed bracketed drive modules 90. At the same time, shifting cylinders 102 are pressurized and shifted so that straightener wheel frame 96 has its gap between its two idler rollers 160 centered on the longitudinal axis of housing 80. This condition is illustrated in FIG. 19. Similarly, the slips 122 of slip unit 14 are retracted by pressurizing slip cylinders 127 to cause rod 128 with the attached slip to be pulled upwardly. At this point, tubing 10 can be fed through the curvature adjuster 16, the slip unit 14, and the traction drive 12 and thence into the blowout preventers 3 and 4 and the well.

After the tubing 10 is deployed through the units of the injector, the squeeze cylinders 29 are first adjusted by applying pressure to extend their rods 30 or releasing the retraction screws. In the preferred arrangement of squeeze cylinders 29, cylinder bias springs 31 urge the drive modules 40 of the traction drive 12 into engagement with the tubing 10 without excessive force. When the tubing path has been inspected through the traction drive 12 to ensure proper centralization, if the squeeze cylinders 29 are hydraulically operated, they can be pressurized to extend their piston rods 30 to press on their respective drive modules 40. This inward biasing of the drive modules 40 results in the simultaneous and uniform gripping of tubing 10 between the opposed sets of drive rollers 60. The uniformity of squeeze by the rollers is ensured by manifolding all of the squeeze cylinders 29 together and/or using similar spring preloads. Next, the actuator cylinders 93 for the bracketed drive modules 93 and the shifting cylinders 102 for the straightener wheel frame are adjusted to the appropriate one of their operational positions, shown in FIGS. 19–21, for adjusting the tubing curvature. In the event that spring-loaded squeeze cylinders 29 are used, they are actuated by releasing the piston rods 30 from the retractor screws.

When driving the tubing in either direction, the appropriate ports 53 or 253 of the individual hydraulic drive motors 50 or 250 are simultaneously pressurized to initiate their rotation and that of the attached drive rollers 60 in the desired direction. The motors 50 or 250 are manifolded together, so only one control valve is required to actuate and control the traction drive 12. For clarity, the interconnecting hydraulic tubing and the hydraulic system components are not shown, but these items are well known to those skilled in the art. Because squeeze cylinders 29 exert a substantial normal load on tubing 10 from drive rollers 60, the frictional shear required between rollers 60 and tubing 10 in order to modify the axial force on the tubing can be developed. Since the tubing 10 is well supported by any opposed set of rollers 60 and likewise is supported on a different axis rotated 90° apart by the adjacent sets of rollers 60 on either side, ovalization of the tubing is minimized.

Figure 21:
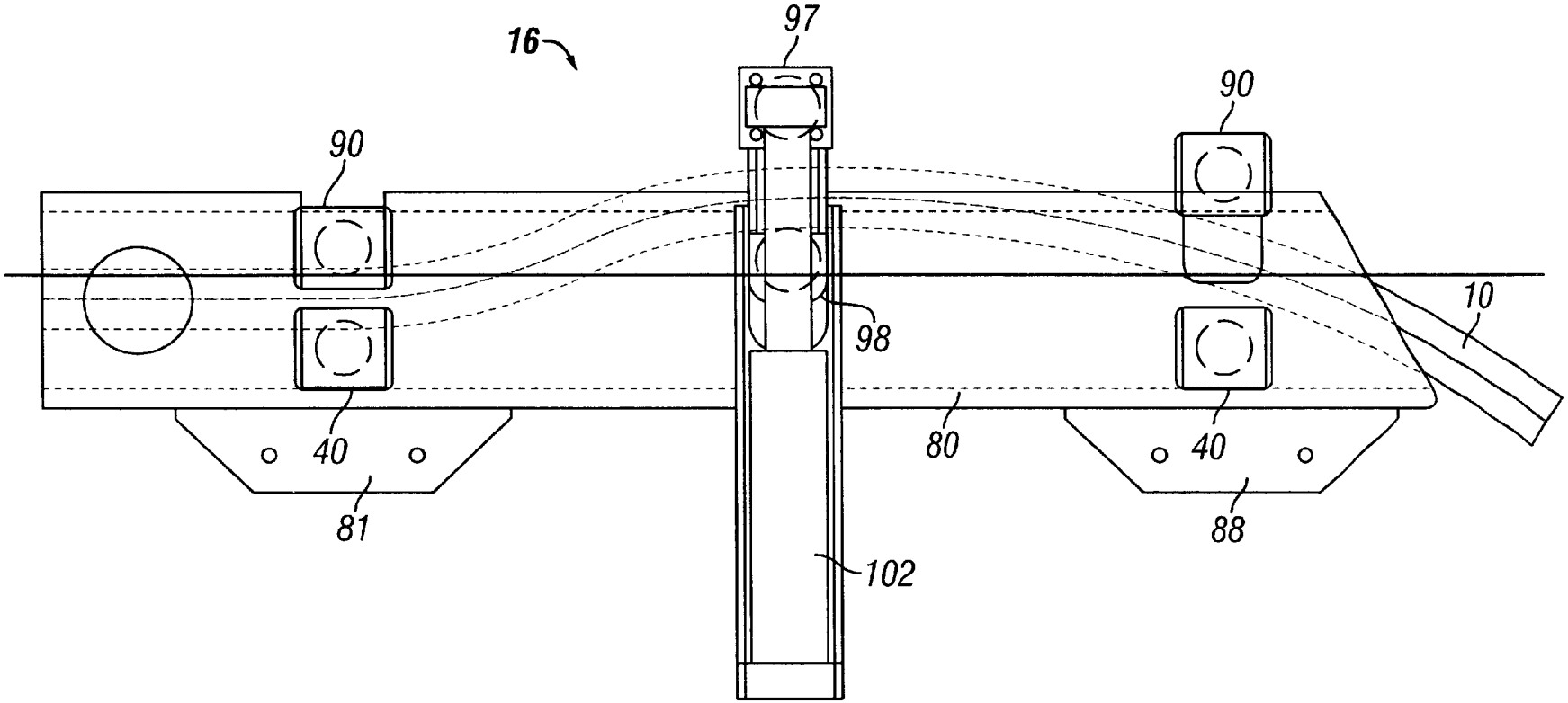
FIG. 21 corresponds to FIG. 19, but shows the unit adjusted to bend the tubing exiting from the tractive portion of the injector to develop a proper configuration for the overbend of the tubing in its arcuate path to the storage reel.

Selective adjustment of the curvature adjuster 16 of this invention permits some amount of control of both the trajectory of the tubing between the storage reel and the injector and the straightness of the tubing entering the well. Referring to FIG. 21 which shows the loading positions of the rollers 60 in the curvature adjuster 16, it can be seen that both bracketed drive modules 90 are backed off and the straightener wheel frame is shifted sufficiently away from the longitudinal centerline of housing 80 so that the tubing 10 is not being bent by the curvature adjuster.

Figure 20:
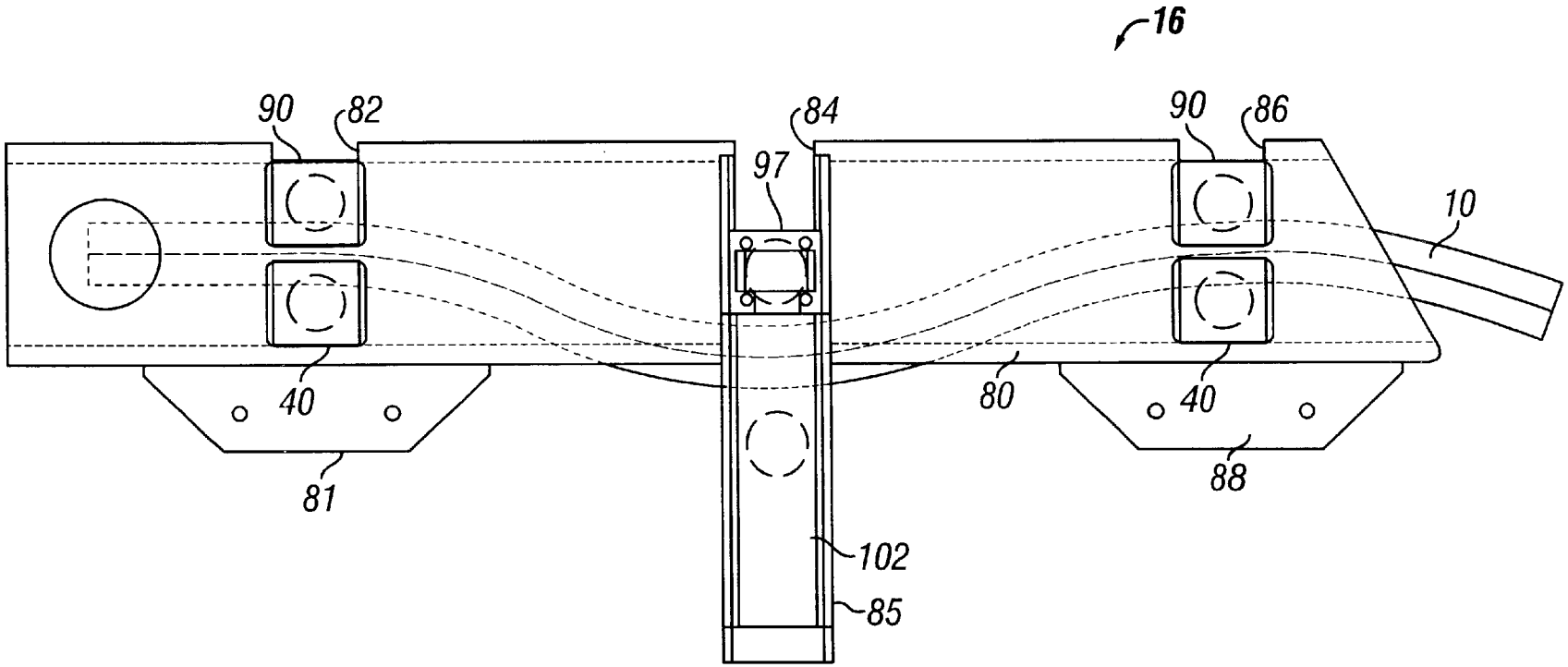
FIG. 20 corresponds to FIG. 19, but shows the unit adjusted to straighten the tubing prior to its passing through the tractive portion of the injector and thence into the well.

FIG. 20 illustrates the adjustment of the curvature adjuster when tubing is being drawn from the storage reel 8 and injected into a well. In FIG. 20, the bracketed drive modules 90 are urged toward the stationary drive modules 40 so that the tubing 10 is gripped therebetween at both the upper and lower ends of the housing of the curvature adjuster 16. The gripping permits the bracketed 90 and regular drive modules 40 to drive the tubing axially. The drive modules 90 and 40 of the curvature adjuster 16 are also manifolded to the drive modules 40 of the traction drive 12 so that they work cooperatively. During the insertion of tubing into the well, it is desirable to eliminate the residual curvature of the tubing 10 as it comes from the reel 8 by reverse bending it in a controlled manner. This reverse bending is done by retracting the rods 101 of shifting cylinders 102 so that straightener wheel frame 96 has its distal roller 60 imparting sufficient bending and force to the tubing in the powered three-wheel straightener of the curvature adjuster 16. The position of straightener wheel frame 96 can be predetermined so that it can be maintained in a fixed position against a stop, or the position can be selectably varied in order to compensate for the variability of the curvature of the tubing emerging from the reel.

The recurvature of the tubing 10 emerging from the well by the curvature adjuster 16 is illustrated in FIG. 21. In this case, it is desired to impart some recurving of the tubing between the injector and the reel 8 so that it will follow a desired trajectory. In some cases, it may be possible to operate without the need for intermediate positional guides such as the goosenecks familiar to those skilled in the art. In the case of recurving of the tubing, the straightener wheel frame 96 is shifted so that its near side (inside) roller 60 contacts the tubing to cause bending of the tubing between its support points at the lower and upper bracketed drive modules 90. For this operation, only the lower bracketed drive module 90 and the lower drive module 40 jointly squeeze the tubing 10 for driving; the position of the upper bracketed drive module 90 is backed off sufficiently to prevent squeezing of the tube. The position of upper bracketed drive module 90 can be varied jointly with that of the near side roller 60 of the straightener frame 96 to achieve both the desired exit curvature and trajectory for the tubing.

The operation of the thrust enhancer 180 is basically a hand-over-hand operation. In general, this thrust enhancer is only used when the tubing 10 is stuck by a sand bridge or otherwise obstructed or a packer or similar device is being retrieved from the hole. The unit can be used to thrust in both directions if necessary. For pulling the tubing upwardly out of the well, the moveable lower tubing gripper 181*b* is clamped to the tubing 10 when the reciprocating moveable second transverse bulkhead is in its lower position. The hydraulic thrust cylinders 182 are then used to pull the lower transverse bulkhead 186 with its attached gripper 181*b* and tubing 10 upwardly. In the event that multiple strokes are required, the stationary tubing gripper 181*a* is then set and the moving gripper 181*b* is released. Following this, the moving second transverse bulkhead 186 with its attached gripper 181*b* is returned to its lower position for another stroke. In order to thrust downwardly, the lower gripper is attached at the upper position of bulkhead 186 and released at the lower position of bulkhead 186.

The operation of the slip unit 14, shown in FIG. 23, involves pressurizing the rod end of the slip cylinders 125 in order to retract the slip wedges 129. When the cylinder end of slip cylinders 125 is pressurized, then slips 129 are driven downwardly on converging tracks so that they will grip and hold tubing 10 for loads in the downward direction. The slip unit 14 is shown configured for holding downward loads only, but the unit could easily be made to hold upward loads for higher pressure wells as well by adding another inverted pair of slip tracks 114, slip cylinders 125, and slips 129.

Figure 33:
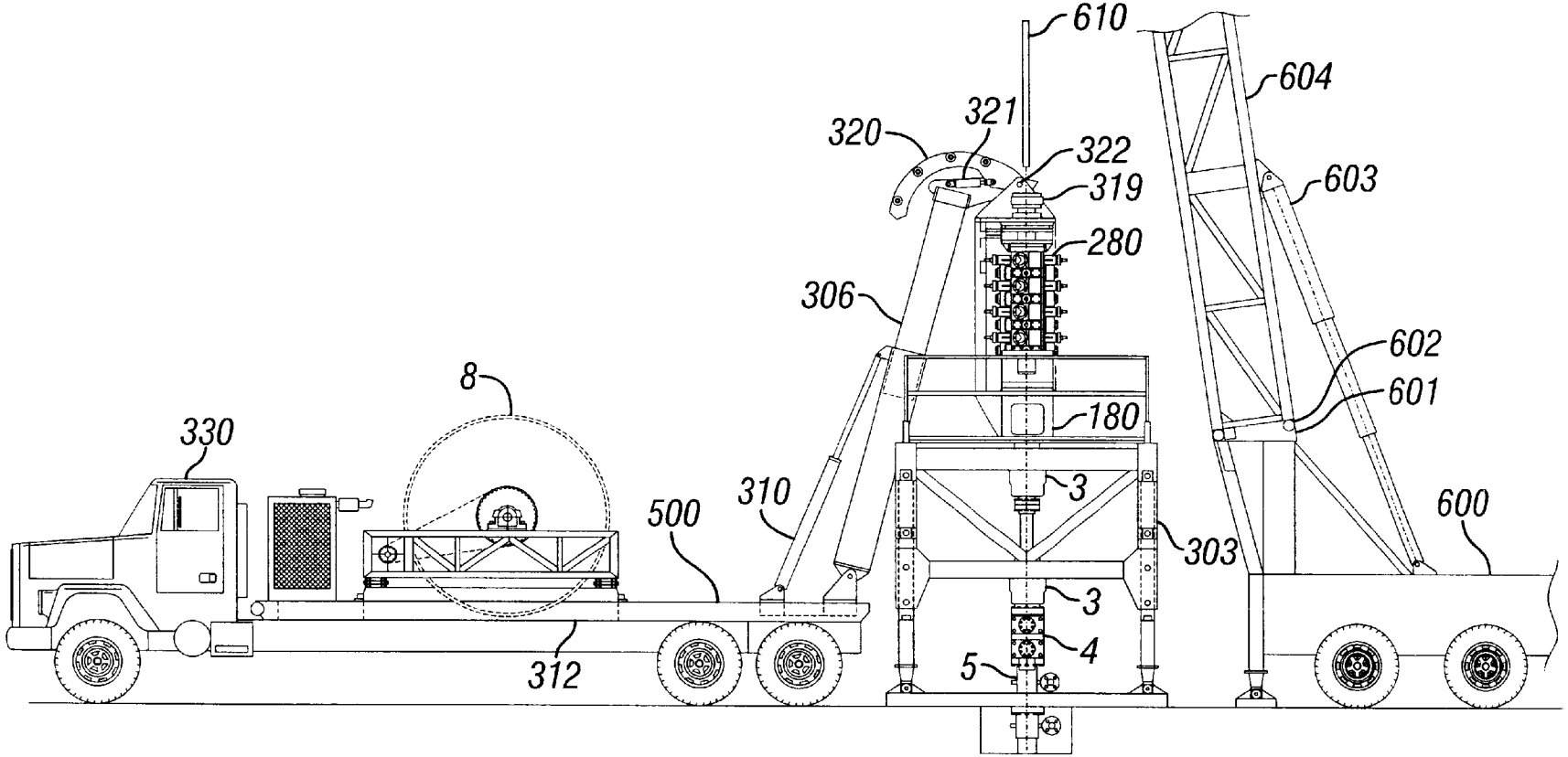
FIG. 33 shows the same system as is shown in FIGS. 31 and 32 with an auxiliary work platform and mast used for snubbing stalked tubing into a well.

When either the injection unit 2 or 280 is used with stalked tubing 610, as is shown in FIG. 33, the operation is modified and somewhat simplified because the stalked tubing is basically straight and remains so during operations on the surface. Accordingly, it is not necessary to use the coiled tubing reel 8, the gooseneck 320, the levelwind 9, the straightener 16, the arc corrector 700, or the arc sensor 360 for stalked tubing operations. The passage of upset tubing joints through the injector 2 is straightforward if sufficient travel of the rods 30 of squeeze cylinders 29 is provided. Proper spring choice for an all spring bias or combined spring and hydraulic bias is necessary to avoid overstress or breakage. If a hydraulic bias is used on squeeze cylinders 29, then an accumulator must be placed in the circuit on the rod extend side in order to reduce hydraulic system stiffness sufficiently to avoid overpressure or insufficient ability to retract and pass the upset connection with the drive torque available.

An Arc Corrector Unit of the Present Invention

Figure 27:
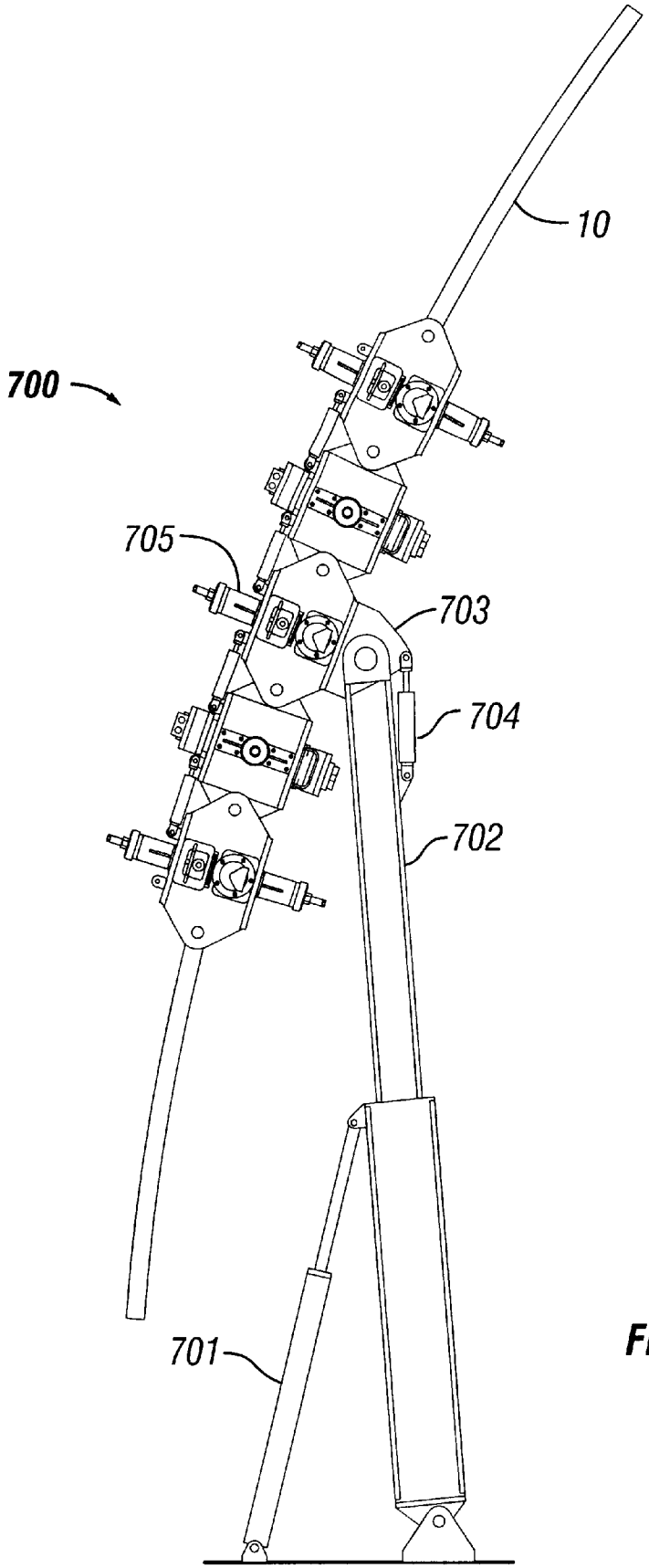
FIG. 27 is a side profile view of the arc curvature corrector mounted on its support frame.

The drive means of the present invention is useful in a number of applications. For example, FIG. 27 shows an alternative structural arrangement of the drive means, called an arc corrector unit 700, which provides the combined functions of both levelwinding and control of the arc path of coiled tubing 10 between reel 8 and the injector unit 2.

Figure 26:
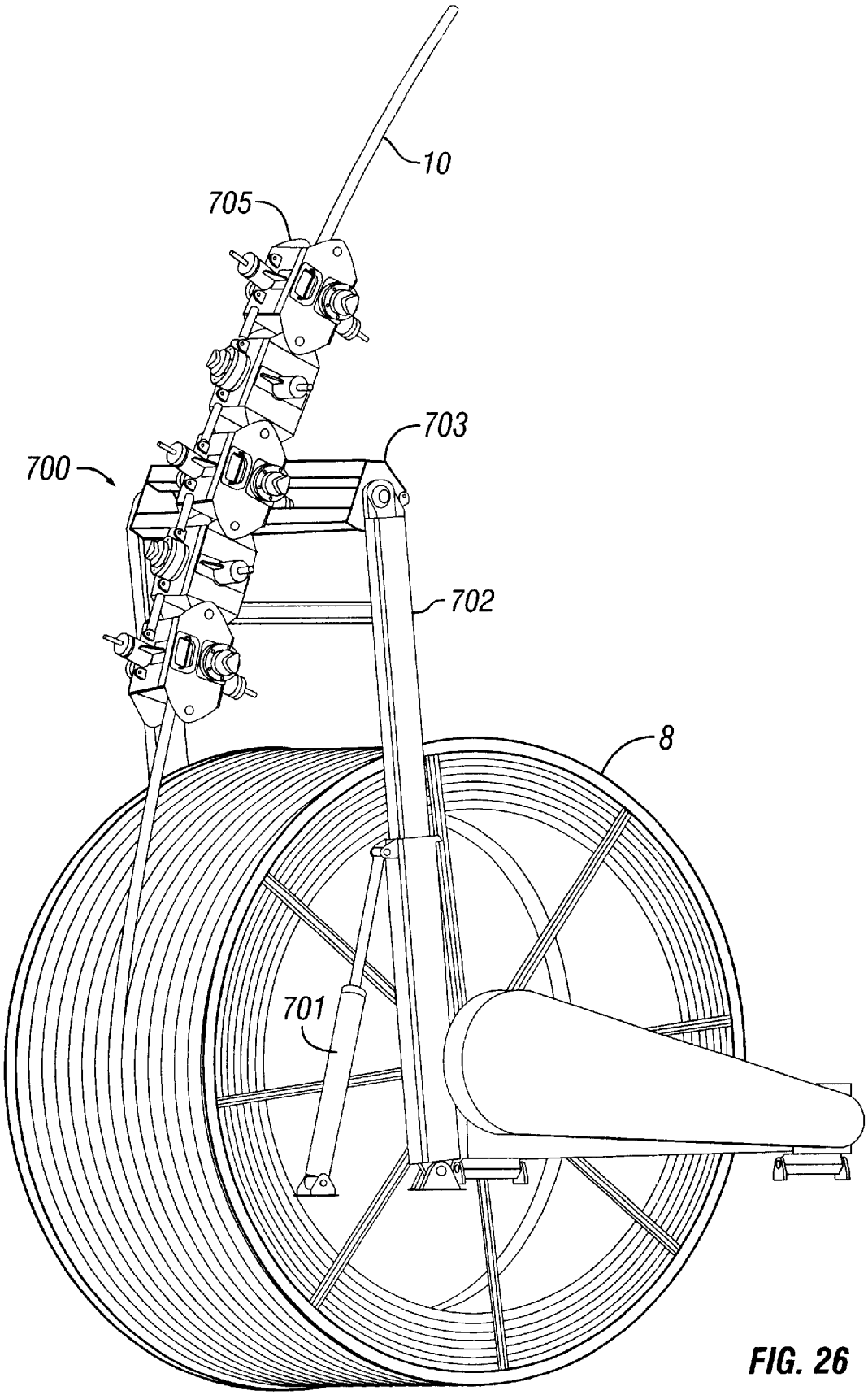
FIG. 26 is an oblique view of the arc curvature corrector of this invention showing its mounting relationship to the coiled tubing reel and its mounting on the support frame.

This type of device is more suitable for tubing arc control than using a conventional gooseneck when the tubing must span a large distance between the reel 8 and the injector unit 2. As seen in FIG. 26, the arc corrector unit 700 is pivotably mounted to the rig deck supporting the reel 8 close to the reel by a hydraulically extensible inverted U-shaped straddling frame 702. The pivot axes for frame 702 are parallel to the axis of reel 8. Symmetrically positioned frame erection cylinders 701 are used to erect and lower frame 702 between a stowed position and its erected position shown in FIG. 27. The horizontal crossbar 703 of the U-shaped frame 702 is composed of two parallel rectangular tubular tracks held together with end plates and mounted at either end by coaxial pins parallel to the reel axis. The pins of crossbar 703 are journaled in the upper ends of the vertical legs of frame 702. As illustrated in FIG. 27, the crossbar 703 of frame 702 can be rotated to a desired alignment selectably by means of symmetrically placed rotator cylinders 704, which are attached by ears with pin mountings to both the top of upper vertical legs of frame 702 and to similar ears eccentrically mounted on crossbar 703.

Figure 28:
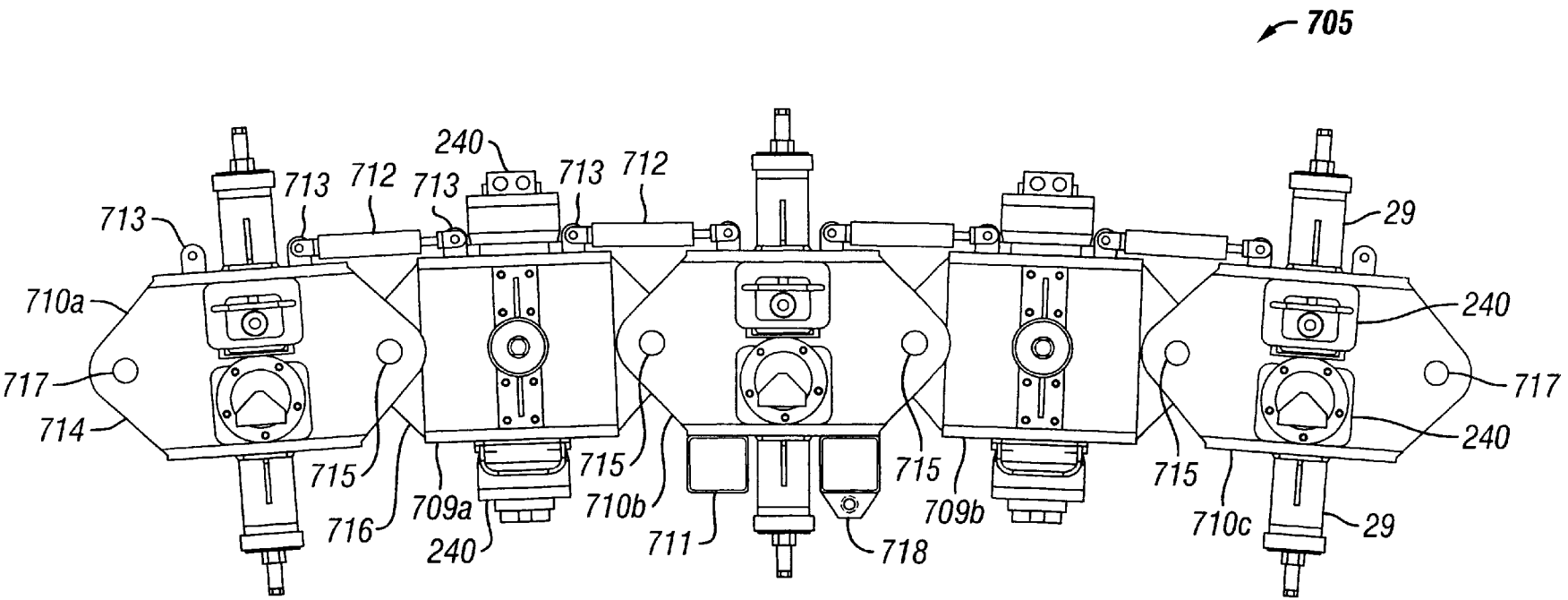
FIG. 28 is a side profile view of the arc curvature corrector showing details of the individual interlinked modules.
Figure 29:
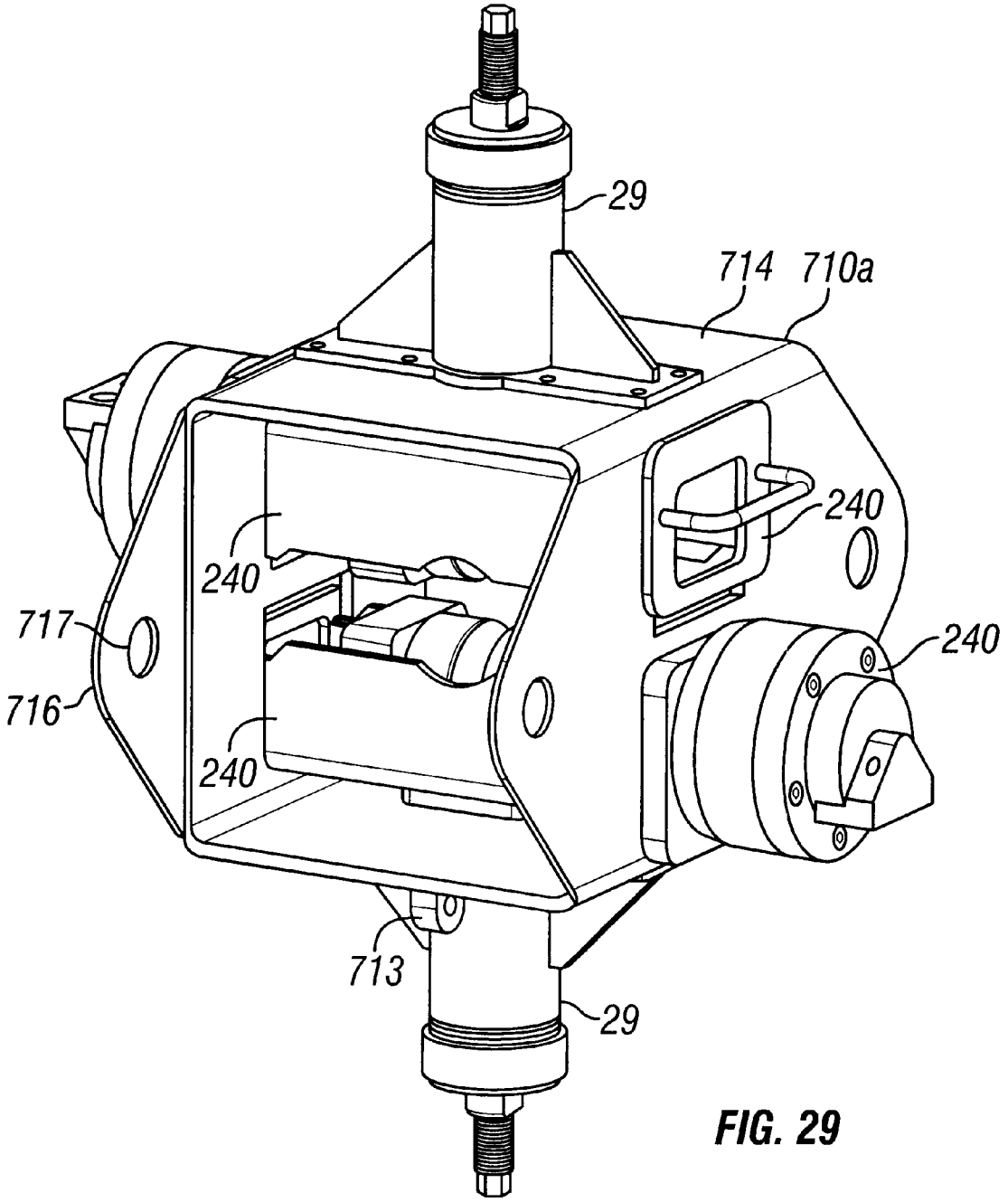
FIG. 29 is an oblique view of an individual module of the arc curvature corrector.

Segmented arc corrector 705, shown in more detail in FIG. 28, is provided with transverse sleeve guides 711 on its central segment 710*b*. The sleeve guides 711 comate with the tubes of the crossbar 703 so that the arc corrector is guided transversely along the crossbar. Levelwinding is accomplished by providing the arc corrector assembly 700 with a screw drive engaging a nonrotating nut 718 which is mounted on one of the guide sleeves 711 of arc corrector 705. FIGS. 28 and 29 show more detail of the arc corrector 705. Articulated arc corrector 705 is composed of alternating multiple flex modules 709*a,b* and 710*a,b,c*. These flex modules are constructed of short segments of square structural tubing 714 with cheek plate extensions 716 which have transverse horizontal pin link holes 717 intersecting their centerlines. The cheek plates 716 of modules 709 and 710 are arranged offset from each other to thereby be interleaved so that short pins 715 can be used on both sides to link the modules at pin link holes 717 in order to form a chain of modules which is flexible in the vertical plane parallel to the longitudinal centerline plane of the rig.

Mounting eyes 713 are symmetrically placed about the transverse midplane of the flex modules on the upper horizontal surfaces of flex modules 709 and 710. Flex cylinders 712 are mounted to the mounting eyes 713 to interconnect adjacent flex modules 709 and 710 and provide an eccentric reaction to those modules, since mounting eyes 713 are offset from the flex module centerlines. This eccentric reaction from flex cylinders 712 can be used to produce bending moments and associated curvature changes in tubing 10 when it is deployed through the arc corrector assembly 700. With the arc corrector 705 flexed and the tubing passing through the arc corrector consequently being bent due to the application of pressure to the flex cylinders 712, arc corrections can be obtained. Varying the pressure of the flex cylinders 712 will result in a consequent change in the curvature of the exiting pipe.

Flex modules 709*a,b* mount opposed drive modules 40, 140, or 240 in opposed vertical transverse slots 26*a,b* and 27*a,b,* while squeeze cylinders 29 are mounted in horizontal opposed holes intersecting the module axes. The arrangement of mountings for drive modules and squeeze cylinders is rotated 90° from that of flex modules 709*a,b* for flex modules 710*a,b,c.* Drive modules 240 are shown in this configuration. The squeeze cylinders 29 urge the drive modules 240 toward the flex module centerline for gripping the tubing 10. Thus, the driving means of the arc corrector assembly 700 is substantially the same as the drive means for the traction drive 12 of the tubing injector 2.

Figure 30:
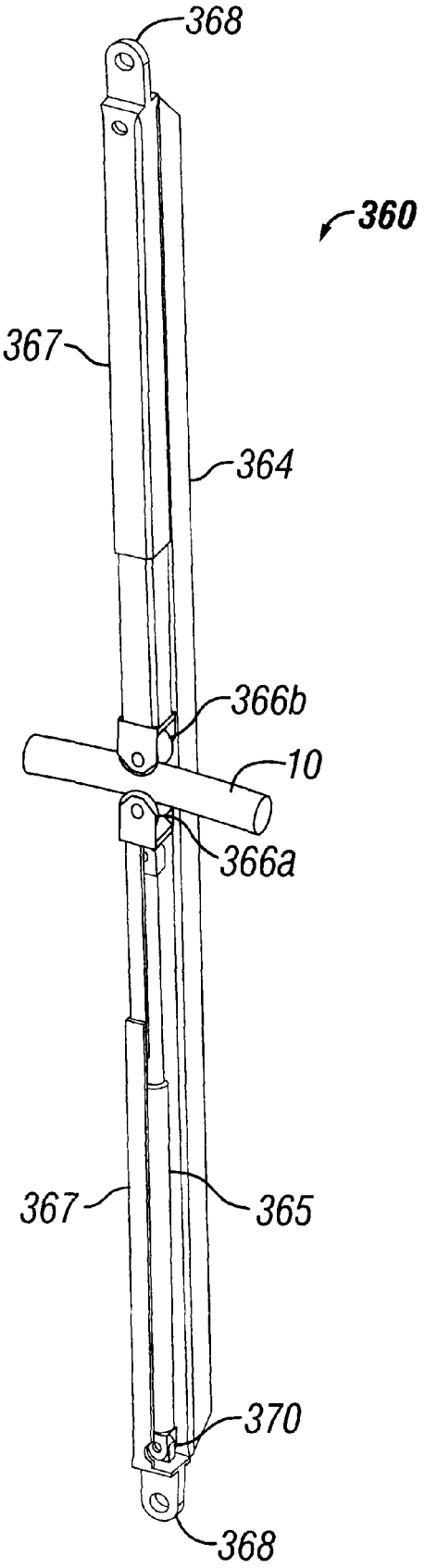
FIG. 30 is an oblique view of an arc sensor device used to monitor the coiled tubing arc between the reel and the top of the tubing injector.

In order to have a reliable reference for evaluating and adjusting the curvature of the arc of the tubing 10 when it is deployed between the reel 8 and the injector 2 or 280 when using the arc corrector assembly 700, an optional arc sensor 360 is used. Arc sensor 360, shown in FIG. 30, consists of elongated strongback 364 which has eyes 368 at its upper and lower ends for interconnection to supporting cables 361 and 362. Nonrotating telescoping guides 367 are fixed to strongback 364 on one side with their telescoping ends oriented toward the center of strongback 364. Each telescoping guide has a roller 366 at the exposed tip of its telescoping inner section. The rollers have their axes positioned to be substantially horizontal and perpendicular to the surface of strongback 364 on which guides 367 are mounted. Internal to each telescoping guide 367 is a double-acting single-ended pneumatic cylinder 365. The piston side of each of the two cylinders 365*a,b* is filled to the same predetermined precharge pressure so that the cylinders 365 bias the rollers 366 inwardly. The tubing 10 is then engaged between the two opposed and preloaded rollers 366*a,b.* A differential pressure gauge is then connected between the piston side ports of the cylinders 365*a,b* for monitoring the relative displacements of the tubing 10 and hence the rollers 366*a,b* from the balanced center position of the arc sensor 360.

Tubing Injection System of the Present Invention

The tubing injector of the present invention is considerably lighter weight and more compact than any tubing injector currently available. Thus, the tubing injector 2 or 280 can conveniently be fit with the other components for the tubing injection system onto a truck, a trailer, or a skid. The tubing injection system of the present invention may be configured with different components and in different configurations to allow for a simplified and less expensive transport of the tubing injection system into the field where it is used. Several examples of mobilized tubing injection systems are shown in FIGS. 31–36.

Figure 31:
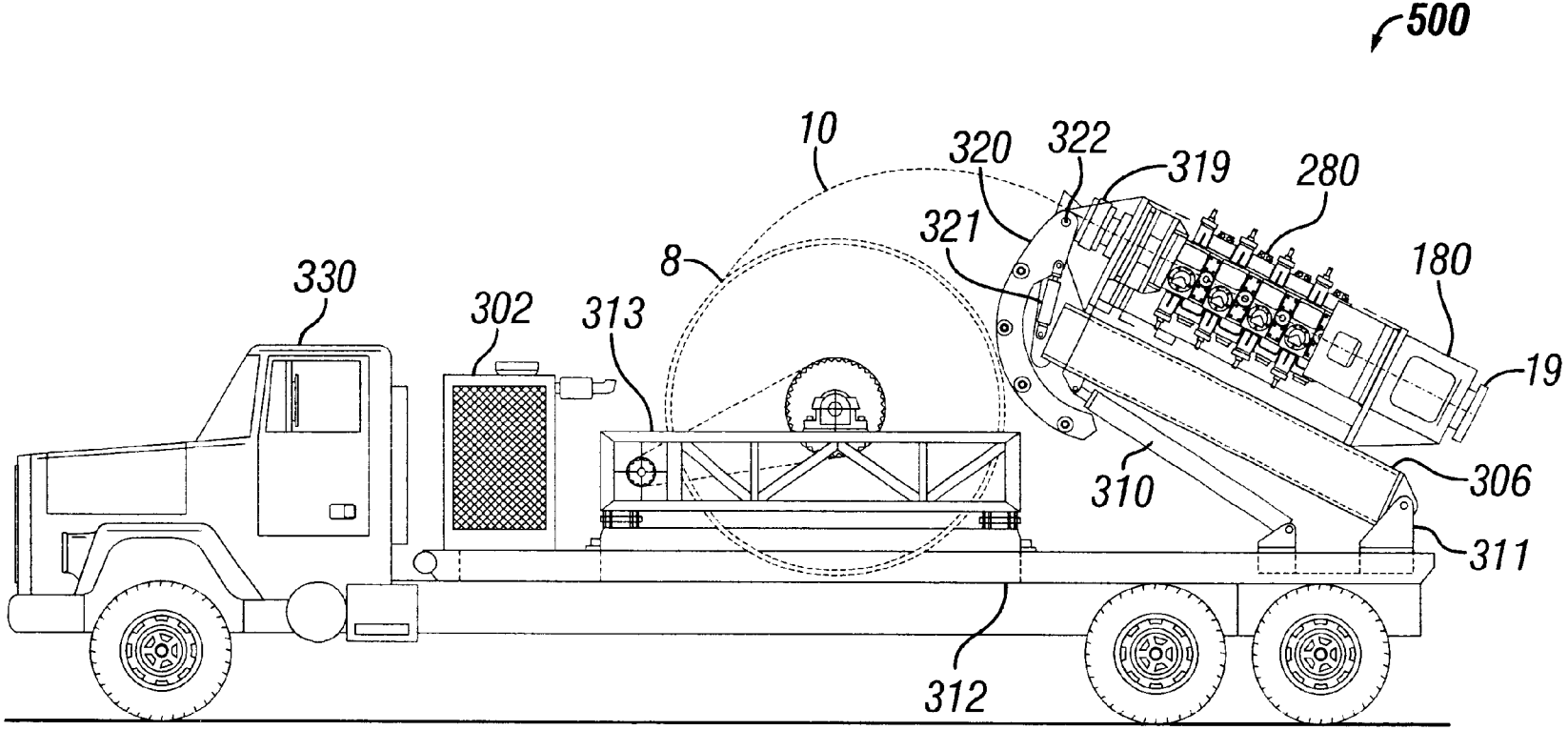
FIG. 31 is a side profile view of a truck-mounted embodiment of the invention wherein the system is configured to be used with an integral reel of coiled tubing, but no integral mast is provided.
Figure 32:
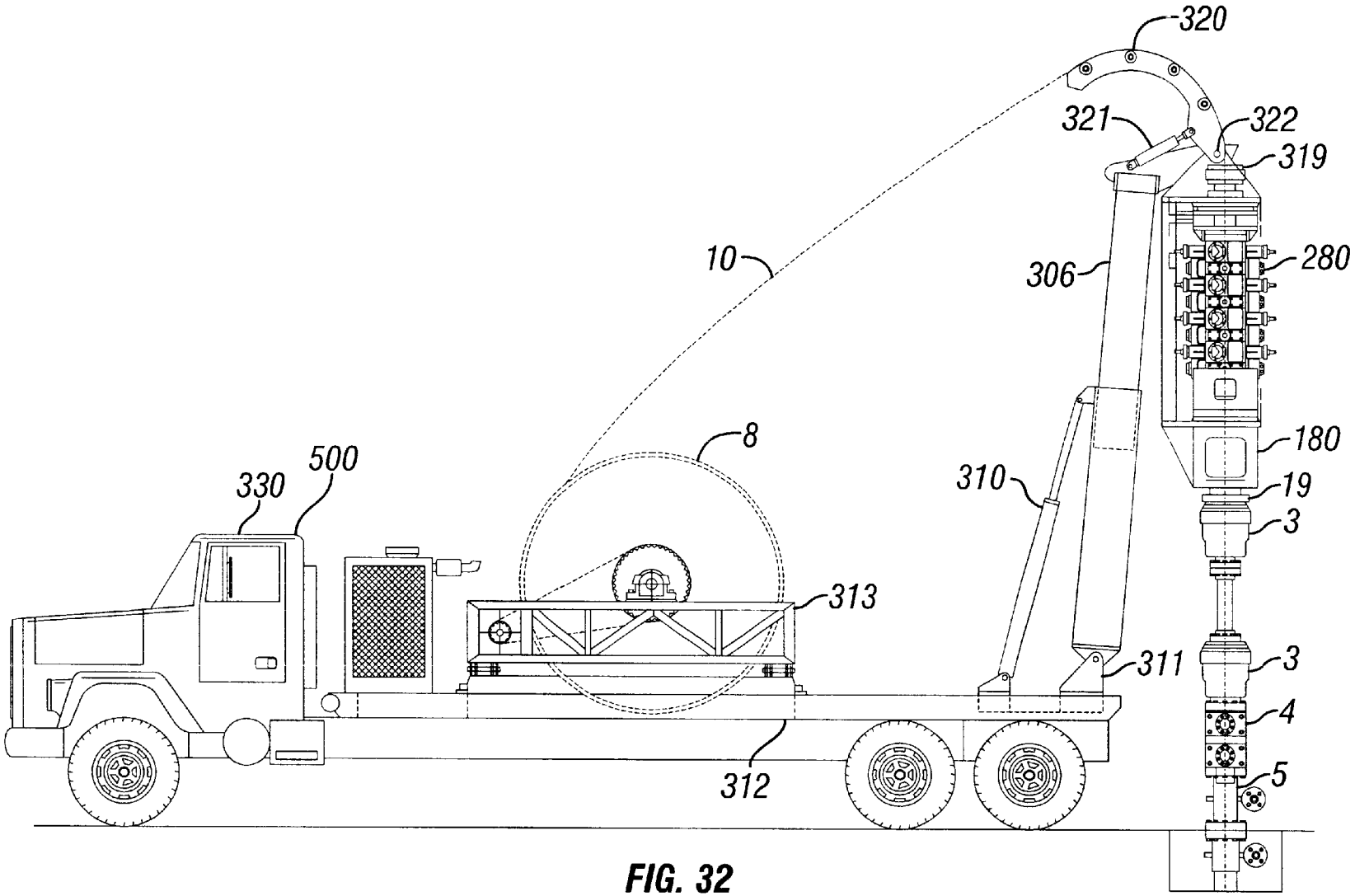
FIG. 32 is a view corresponding to that of FIG. 31, but showing the system set up for working on a well with coiled tubing.

FIGS. 31–33 show a tubing injection system similar to that illustrated in FIG. 1 configured to be mounted on a truck. FIGS. 31, 32 and 33 show how a truck-mounted unit 500 primarily intended for coiled tubing work can be set up for either coiled tubing or stalked tubing injection service. In FIG. 31, the unit is shown in a stowed position for highway travel. In FIG. 32, the unit is set up for a coiled tubing injection job. FIG. 33 shows the unit arranged to perform a stalked tubing snubbing operation.

Truck 330 supports frame-mounted skid 312 which carries the unit. Skid 312 supports prime mover 302 which is an engine-driven hydraulic power source. Coiled tubing reel 8 is mounted on laterally reciprocable reel base 313 which moves transversely to the truck midplane and provides the levelwinding function for reel 8, rather than utilizing a separate levelwind device. Injector unit 280 has a thrust enhancer 180 mounted on its lower end and an adapter spool 19 mounted on the lower end of the thrust enhancer. The upper portion of injector unit 280 in this case does not have an integral straightener, because the system is close-coupled so that the tubing 10 is well supported and controlled between the reel 8 and the injector 280 with only a gooseneck 320 being required for trajectory control.

Gooseneck 320 is pivotably mounted by coaxial symmetrically positioned pins 322 perpendicular to the midplane of truck 330 to the upper end of injector 280. Gooseneck elevator cylinder 321 is attached to the upper end of injector 280 and the gooseneck on its other end and is used to fold or erect gooseneck 320 for operation. Power tong 319 is mounted on the upper end of injector unit 280 in between the mounting pins for gooseneck 320. Power tong 319 is used to make up and break out threaded tubular connections when rig 500 is used for stalked tubing work. Injector boom 306 pivotably supports at its upper end the injector 280 and its attached thrust enhancer 180, adapter spool, and the gooseneck 320.

Injector boom 306 is pivotably mounted on the centerline of truck 330 by pedestal 311 positioned at the rear of skid 312 and is hydraulically extensible. The pivotable mounting of boom 306 is such that the boom and injector 280 are moved in the center plane of the skid 312 between their stowed and erected positions. Symmetrically positioned injector elevator cylinders 310 erect and lower the injector boom 306.

In FIG. 32, truck-mounted coiled tubing rig 500 is set up on a well location for performing coiled tubing injection. Boom 306 is erected and suspended so that the injector 280 and its attached thrust enhancer 180 and the adapter spool 19 are coaxial with the wellhead. In this case, two annular blowout preventers 3 and a ram blowout preventer 4 are mounted by means of connector spool 5 to the wellhead and the adapter spool 19 of rig 500. The gooseneck 320 is erected by cylinders 321 and the coiled tubing is deployed between reel 8 and injector 280, passing over the intermediate gooseneck 320 and hence into the well through the preventers.

In FIG. 33, the coiled tubing rig 500 is deployed for performing a snubbing job with stalked threaded tubing. FIG. 33 shows the tubing injection system shown in FIGS. 31 and 32 adapted for use in snubbing stalked tubing into a well. In this case, a work platform and an auxiliary mast mounted on a separate trailer are added to the truck mounted system.

In this case of snubbing stalked tubing, the boom 306 is erected and suspended so that the injector 280 and its attached thrust enhancer 180 and the adapter spool 19 are coaxial with the wellhead. Work platform 303 is positioned coaxial with and over the wellhead to provide operator access. In this case, two annular blowout preventers 3 and a ram blowout preventer 4 are mounted by means of connector spool 5 to the wellhead and the adapter spool 19 of rig 500. The gooseneck 320 is not erected by cylinders 321, and the coiled tubing is not deployed from reel 8. The stalked tubing 610 is lifted and positioned for makeup or lifted for stowage by separate, autonomous workover rig 600. Rig 600 has a mast pedestal 601 which supports mast 604 by means of pivot 602. Mast erection cylinders 603 serve to raise and lower mast 604 and to position its traveling block over the well centerline.

When either the injection unit 2 or 280 is used with stalked tubing 610, as is shown in FIG. 33, the operation is modified and somewhat simplified because the stalked tubing is basically straight and remains so during operations on the surface. Accordingly, it is not necessary to use the coiled tubing reel 8, the gooseneck 320, the levelwind 9, the straightener 16, the arc corrector 350, or the arc sensor 355 for stalked tubing operations. The passage of upset tubing joints through the injector 2 is straightforward if sufficient travel of the rods 30 of squeeze cylinders 29 is provided. Proper spring choice for an all spring bias or combined spring and hydraulic bias is necessary to avoid overstress or breakage. If a hydraulic bias is used on squeeze cylinders 29, then an accumulator must be placed in the circuit on the rod extend side in order to reduce hydraulic system stiffness sufficiently to avoid overpressure or insufficient ability to retract and pass the upset connection with the drive torque available.

Figure 34:
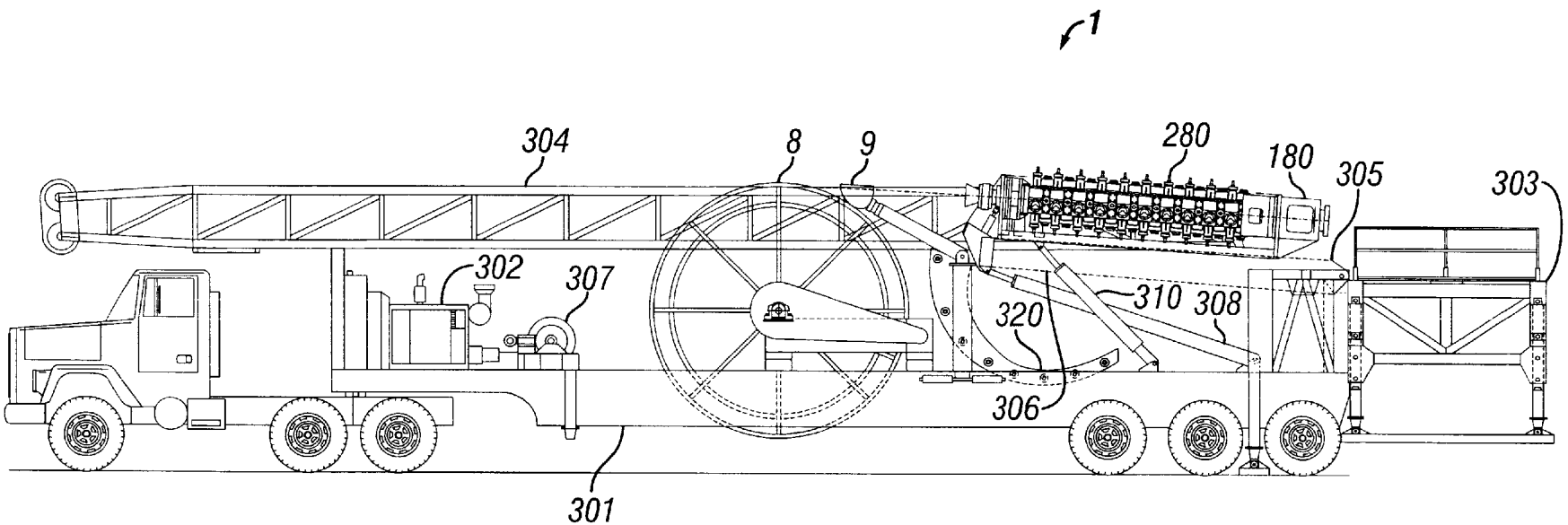
FIG. 34 is a side profile view of one embodiment of a trailer-mounted tubing injection system configured with both a reel of coiled tubing and an integral mast for use with stalked tubing.
Figure 35:
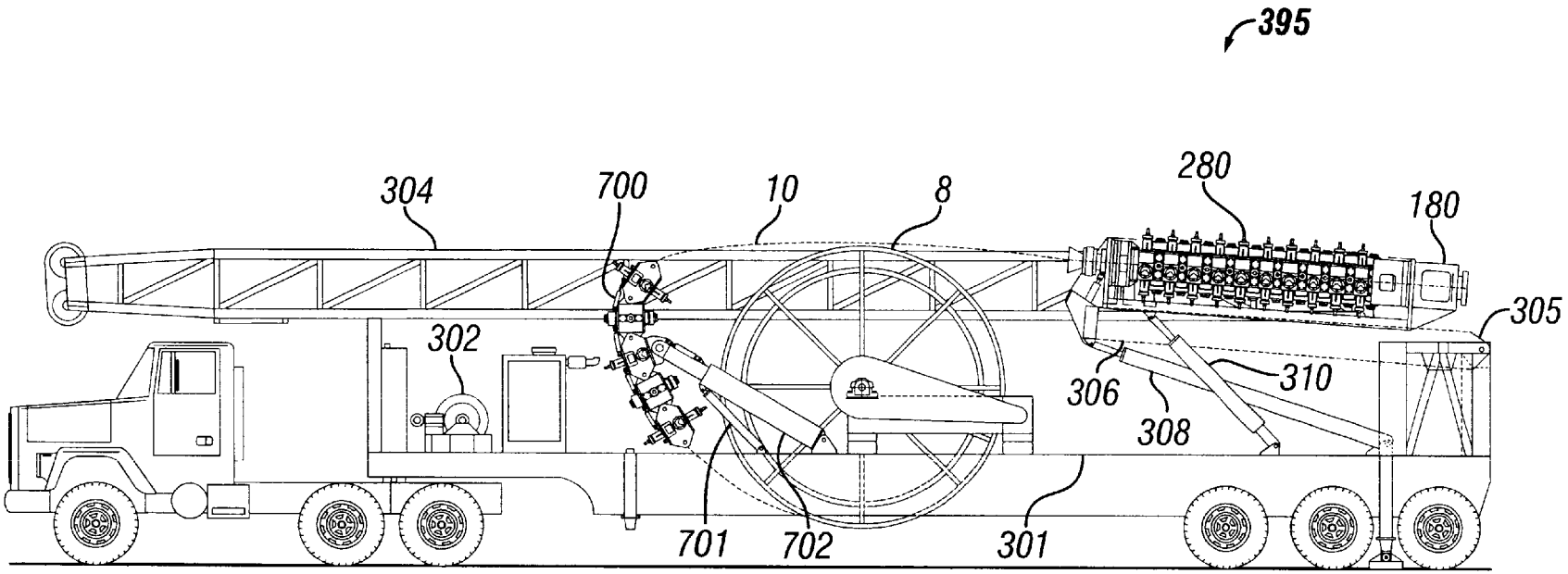
FIG. 35 shows another trailer-mounted tubing injection system usable for both coiled and stalked tubing.
Figure 36:
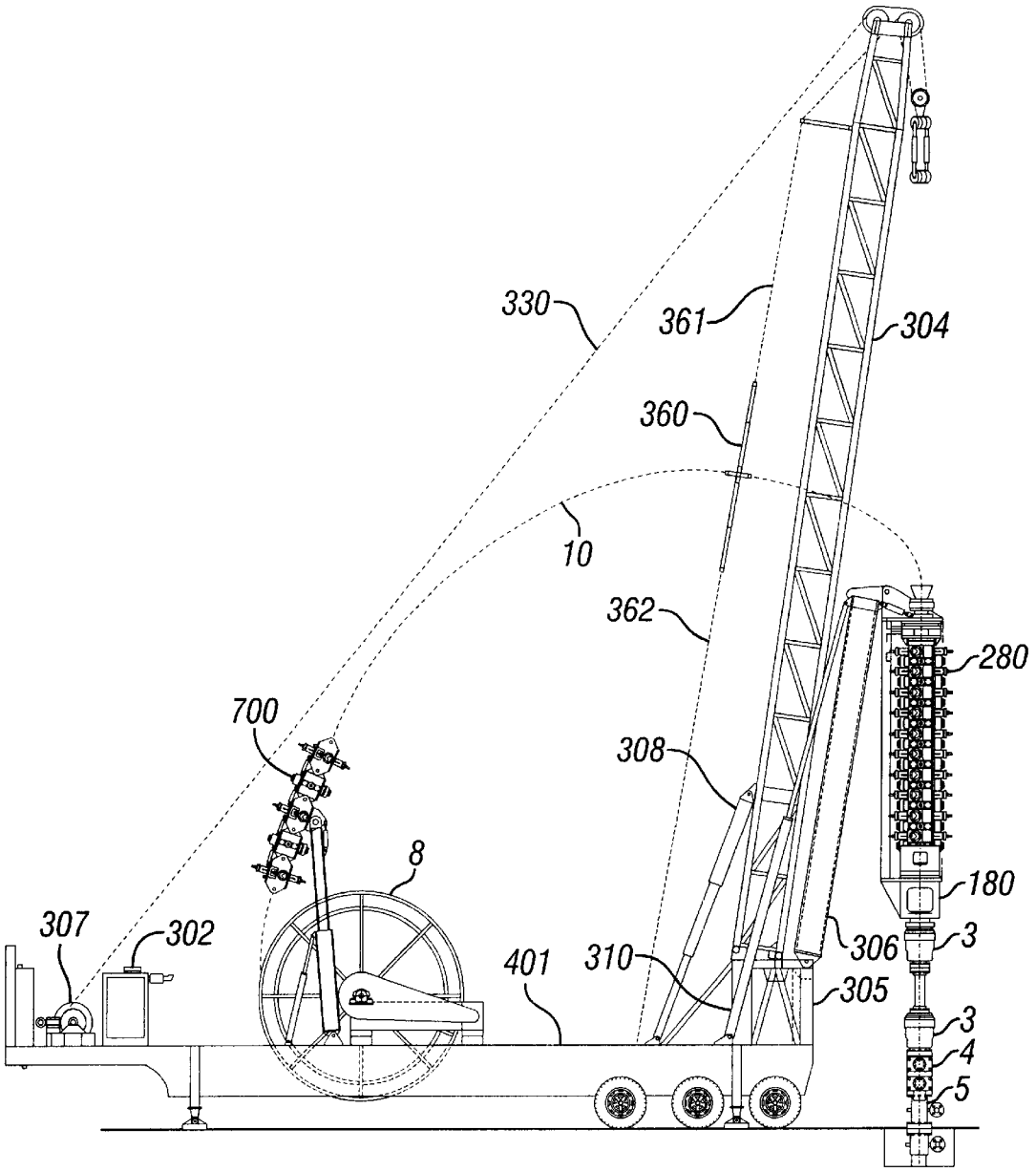
FIG. 36 shows the tubing injection system of FIG. 35 set up for working on a well with coiled tubing.

The trailer mounted tubing injection systems shown in FIGS. 34 and 35 are configured as combination rigs for use with both coiled tubing and stalked tubing. FIGS. 34 and 35 show different configurations of the unit stowed for road transportation. In FIG. 36, the unit shown in FIG. 35 is set up for a coiled tubing injection job.

The basic elements of the rigs shown in FIGS. 34–36 are the injector unit 280, one or more spherical blowout preventers 3, the ram blowout preventer 4, the flanged connector spool 5, the tubing storage reel 8, the level wind unit 9, and the tubing 10. The tubing 10 is run from the storage reel 8 through the level wind unit 9 and thence into the injector unit 280 and into the wellhead through the preventers 3 and 4 and connector spool 5. Flanged connector spool 5 is bolted to the wellhead of a preexisting well, along with the blowout preventers 3 and 4 in order to provide well control. The spool 5 and preventers 3 and 4 are not shown in FIG. 34 for clarity. The tubing is fed into the well for performing well operations known to those skilled in the art.

In FIG. 34, these pipe handling items are mounted on a truck-drawn trailer 301 which has a engine-driven hydraulic power unit 302 and a removable work platform 303 attached to the rear of the trailer. If required, the work platform may be dismounted and positioned straddling the wellhead, as shown in FIG. 33. Conventional workover mast 304 is pivotally mounted on supporting pedestal 305 at the rear of trailer 301 and straddles the injector unit 280. Injector unit 280 is pivotably mounted at its top to the top of hydraulically extensible injector boom 306, which is in turn pivotably mounted on its bottom end to the pedestal 305 of trailer 301. The pivot axes are normal to the longitudinal midplane of the trailer 301 and the mast, pedestal, injector boom 306, and injector 280 are positioned on the centerline of trailer 301. Double drum winch 307 has its lines 330 reeved through the sheaves at the upper end of mast 304 and then connected to traveling blocks in order to permit the mast. Mast 304 is raised and lowered into position by mast elevator hydraulic cylinders 308 which are symmetrically positioned about the mast centerline and have their cylinders pivotably mounted to the trailer deck and their rods pivotably attached to the lower longitudinal chords of the mast truss. Injector unit 280 is similarly raised and lowered by injector elevator hydraulic cylinders 310. Although the rig shown in FIG. 36 corresponds to the rig embodiment of FIG. 35, rather than the rig embodiment of FIG. 34, the injector and mast mountings for the two cases are identical. Hence, FIG. 36 also shows how the mast 304 and injector unit 280 for the embodiment shown in FIG. 35 may be raised to their working positions by their respective elevator cylinders 308 and 310.

The trailer-mounted rig 395 shown in FIG. 35 in its traveling configuration and in FIG. 36 in its configuration rigged for doing a coiled tubing injection job. Rig 395 is mounted on a trailer 401 which has a prime mover 302, a mast pedestal 305, nontraversing reel 8, dual drum winch 307, pivotally erectable mast 304, and pivotally erectable injector 280. Rig 395 is substantially equivalent to rig 1, shown in FIG. 34, except that the levelwind device 9 and the gooseneck 320 of rig 1 have been replaced by the arc corrector assembly 700. Additionally, as shown in FIG. 36, arc sensor 360 is employed to assist in maintaining proper control of the arc of tubing 10 for rig 395.

As seen in FIG. 26, the arc corrector unit 700 is pivotably mounted to the rig deck supporting the reel 8 close to the reel by a hydraulically extensible inverted U-shaped straddling frame 702. The pivot axes for frame 702 are parallel to the axis of reel 8. Symmetrically positioned frame erection cylinders 701 are used to erect and lower frame 702 between its stowed position shown in FIG. 35 and its erected position seen in FIG. 36.

In order to have a reliable reference for evaluating and adjusting the curvature of the arc of the tubing 10 when it is deployed between the reel 8 and the injector 2 or 280 when using the arc corrector assembly 700, as shown for second trailer-mounted rig embodiment 395 in FIG. 36, arc sensor 360 is used. Arc sensor 360 is mounted from upper cable 361 hung from the mast 304 and stayed by bottom cable 362 tied to the floor of trailer 401.

Advantages of the Invention

The new injector of this invention offers several important advantages over conventional hardware. A very significant advantage is the relatively small size and weight of the injector. This feature is important for areas where significant weight limits are placed on vehicles. Another advantage is the modularity of the unit, which leads to fabrication savings, inventory minimization, and improved serviceability. Assembly and disassembly are both very simple for this construction, so the changing out of drive modules is easy and rapid. Using the third embodiment of the drive module, for which only a single screw must be removed to access the drive rollers and roller bearings, the change of bearings and drive rollers is much simpler than the case for competitive equipment design. Thus, the injector can be rerigged for a change of tubing size much more simply than any other type of injector. The use of multiple drive modules also adds a high level of redundancy to the system, thereby improving its reliability.

A further advantage is that load sharing of the drive modules is improved. For both conventional track-type injectors and wheel injectors, some slippage or tubing strain must occur because the strain in the tube builds in the direction of increasing tension, while for both track and wheel injectors, the strain in the track or wheel builds in the opposite direction. In the case of the injector of this invention, the individual roller contact patches on the tubing are relatively small and there is less influence of this effect. The alternation of tubing support directions by the drive rollers aids in avoiding ovaling of the tubing under side loads. This basically full support of the tubing is highly desirable for improving tubing life.

Compared with an injector having a linear through path for the tubing, the provision of a mildly sinuous path for the tubing passing through the injector, as shown in FIGS. 13 and 14, experimentally has been shown to permit the development of higher traction forces with a given input power. This advantage is available for coiled tubing injection, but is impractical for stalked tubing because of local kinking and fatigue adjacent the upset threaded joints.

An additional, critical advantage of the injector of this invention is its ability to pass upset tubing joints without overstressing either the tubing or the injector itself. Additionally, the injector of the present invention will not kink an upset tubing joint like a wheel type would. Further, the injector of the present invention will not oval an upset tubing joint like a track type injector would. Therefore, the injector of the present invention is able to safely, effectively, and reliably inject both coiled and stalked tubing, which is not possible with other available injectors. Accordingly, economies may be realized by using the same equipment to perform both types of jobs, where currently two separate specialized types of rig are required. When a wheel type injector, such as that disclosed in U.S. Pat. No. 5,839,514, is used to pass a locally enlarged diameter segment of a tubing, very high bending stresses and strains are concentrated in the standard sized portions of the tubing immediately adjacent to the enlarged segment due to the inability of the wheel to permit the tubing to lay against the wheel surface with a constant centerline radius. This localized stress and bending strain concentration leads to premature fatigue failure and kinks in the tubing at those locations when wheel type injectors are used. When track injectors pass an enlarged diameter segment of tubing, the squeeze force holding the two sides of the injector is all concentrated on the enlarged segment of the tubing, rather than distributed along the length of the tubing adjacent the tracks. This concentration is due to the inherent lack of flexibility of track type injectors. The consequence of the injector squeeze force concentration on a standard upset threaded tubing connection is the permanent ovaling and destruction of the threaded connection. Additionally, the track rollers and their bearings for the track segment supporting the enlarged diameter segment of tubing will also be overstressed during passage through the track injector.

The provision of an integral curvature adjuster with simple controls to substantially straighten the tubing is very helpful in deploying the tubing into the well. Friction between the tubing and the interior wall of the well is considerably reduced with this addition to the equipment. A further advantage of the curvature adjuster is that it can be used to recurve the tubing being withdrawn from a well so that it has a controlled arcuate path between the injector and either the level winder or the storage reel. Loading of the tubing into the injector is also eased by the simple hydraulic opening and closing of the axial pathway through the injector. Having an integral slip with the injector is advantageous because it makes enables disengaging the system hydraulics for repairs or when there are leaks and the tubing does not have to be reciprocated or otherwise manipulated for a period of time.

Provision of the thrust enhancer with the injector permits the injector drive to be sized for peak normal operating load conditions. Typically, much higher axial forces than these peak normal operating loads must be provided in order to free stuck pipe or to unseat a packer or to perform comparative downhole tensioning operations. By relying on the thrust enhancer to provide the excess tension over the peak normal operating load conditions, either a higher tube injection rate can be maintained for a given size power source or a more economical combination for the injector rollers of power source and drive motors can be used.

When the span between the tubing reel and the injector is necessarily large because of trailer axle load limitations or other reasons, it is advantageous to utilize the tubing arc corrector together with the arc sensor to control the tubing path without overstressing the tubing, rather than a conventional gooseneck. This method is easy to monitor due to the inherent simplicity of the arc sensor feedback. Because the tubing reel is typically slow to respond to necessary speed changes for tubing arc control due to its very high rotary inertia when compared to the drives on the arc corrector, better fine control is provided by using the driven arc corrector. Additionally, the arc corrector permits maintaining proper, neat spooling of the tubing on the reel when the injector slows or stops. With a long arc path between the reel and the injector, slack and irregular spooling typically would develop at the reel without the arc corrector maintaining a low level of tension on the tubing paying off the reel. Additionally, the ability of the arc corrector to be used as a level winder permits operating with a reel which cannot be reciprocated without a separate levelwind mechanism.

When the span between the reel and the injector is not overly large and a large reel which cannot be laterally oscillated is used, then a levelwinder is used. In such a case, the level winding and the maintenance of backtension on the reel are provided without the additional expense and complication of the arc corrector.

These and other advantages will be obvious to those skilled in the art. It may be understood readily that certain detail changes from the design herein are still within the scope of this invention.

What is claimed is:

1. An individual drive module for use in a traction drive unit for imparting axial loads to tubing engaged by said traction drive unit, said drive module comprising:

(a) an independent drive motor with an output shaft;

(b) a roller assembly, the roller assembly being supported by a pair of rotary bearings driven by the output shaft of said drive motor, said roller assembly comprising (i) a central roller having a primary circumferential groove with a circularly arcuate cross-section, (ii) a first outer roller having a first annular surface having a secondary circumferential groove with a circularly arcuate cross-section on an inner side of said first outer roller, said secondary groove adjacent a first side of the central roller, and (iii) a second outer roller having a second annular surface having a tertiary circumferential groove with a circularly arcuate cross-section on an inner side of said second outer roller, said tertiary groove adjacent a second side of the central roller, wherein the central roller and the first and second outer rollers are independently rotatable coaxial rollers and the primary, secondary and tertiary grooves have the same arc diameter and are mutually concentric to form a substantially continuous circularly arcuate tubing contact surface; and (c) a housing having a central window, wherein the drive motor and the roller assembly are mounted in the housing, the roller assembly mounted to align the central roller with the central window of the housing.

2. The drive module of claim 1, wherein said housing comprises:

(a) a first housing segment to which the drive motor is mounted; and (b) a second housing segment selectably attachable to the first housing segment, wherein the second housing segment in cooperation with the first housing segment retains the roller assembly and the support bearings in engagement with the drive motor;

whereby the roller assembly and the rotary bearings are removable from the drive module when the second housing segment is detached from the first housing segment.

3. The drive module of claim 1, wherein the arc diameter of the primary groove is substantially equal to a diameter of a length of coiled tubing supported by the roller assembly.

4. The drive module of claim 1, wherein the drive motor is a reversible hydraulic motor.

5. An individual drive module for use in a traction drive unit for imparting axial loads to tubing engaged by said traction drive unit, said drive module comprising:

(a) an independent drive motor with an output shaft;

(b) a roller having a circumferential annular groove, the roller supported by rotary bearings and driven by the output shaft of said drive motor; and (c) a housing having a first housing segment to which the drive motor is mounted and a second housing segment selectably attachable to the first housing segment, wherein the second housing segment in cooperation with the first housing segment retains the roller and the support bearings in engagement with the drive motor.

6. The drive module of claim 5, wherein the roller comprises an independently rotatable central roller section and two independently rotatable coaxial outer roller sections, one outer section on each side of the central roller section.

7. The drive module of claim 5, wherein the annular groove has an arc diameter substantially equal to an outer diameter of a tubing supported by the roller.

8. A traction drive unit for imparting axial loads to tubing, said drive unit comprising:

(a) a pair of drive modules, each drive module comprising (i) a housing having a central window, (ii) an independent drive motor with an output shaft, and (iii) a roller having a circumferential annular groove aligned with the central window of the housing, the roller supported by rotary bearings and driven by the output shaft of said drive motor, wherein the rollers of the pair of drive modules are opposed and independently driven; and (b) biasing means for independently urging the roller of each drive module into engagement with a tubing supported by the opposed rollers.

9. The traction drive unit of claim 8, wherein the roller has a semi-toroidal annular groove with an arc diameter substantially equal to the outer diameter of the tubing supported by the roller.

10. The traction drive unit of claim 8, wherein the pair of opposed rollers are mounted in an alternating pattern 90° apart from adjacent pairs of opposed rollers along the axis of the tubing.

11. The traction drive unit of claim 8, wherein the drive motor is a reversible hydraulic motor.

12. A traction drive unit for imparting axial loads to tubing, said drive unit comprising:

(a) a plurality of pairs of drive modules, each drive module comprising (i) a housing, (ii) an independent drive motor with an output shaft, and (iii) a bearing-supported roller in contact with a tubing, the roller driven by the output shaft of the drive motor, wherein each pair of drive modules have opposed and independently driven rollers and are mounted in an alternating pattern 90° apart from adjacent pairs of drive modules along the axis of the tubing; and (b) tensioning means for independently controlling the axial load applied to the tubing by each roller.

13. The traction drive unit of claim 12, wherein each roller comprises an independently rotatable central roller section and two independently rotatable coaxial outer roller sections, one outer section on each side of the central roller section.

14. The traction drive unit of claim 12, wherein the roller has a semi-toroidal annular groove with an arc diameter substantially equal to the outer diameter of the tubing supported by the roller.

15. The traction drive unit of claim 12, wherein the tensioning means is a spring.

16. The traction drive unit of claim 15, wherein the spring is a coil spring, a Bellville spring, or a wave spring.

17. The traction drive unit of claim 12, wherein the tensioning means is a double-acting hydraulic cylinder.

18. A tubing injector comprising:

(b) a traction drive unit for imparting axial loads to tubing, said drive unit comprising:

(i) a plurality of pairs of drive modules, each drive module comprising a housing, an independent drive motor with an output shaft, and a bearing-supported roller in contact with a tubing, the roller driven by the output shaft of the drive motor, wherein each pair of drive modules have opposed and independently driven rollers;

(ii) tensioning means for independently controlling the axial load applied to the tubing by each roller; and (iii) an injector housing, wherein the pairs of drive modules are mounted in the injector housing in an alternating pattern 90° apart along an axis of the injector housing.

19. The tubing injector of claim 18, wherein each roller comprises an independently rotatable central roller section and two independently rotatable coaxial outer roller sections, one outer section on each side of the central roller section.

20. The tubing injector of claim 18, wherein the roller has a semi-toroidal annular groove with an arc diameter substantially equal to the outer diameter of the tubing supported by the roller.

21. The tubing injector of claim 18, wherein the roller has an arcuate drive face configured to contact the tubing over an arc length of about 100°.

22. The tubing injector of claim 18, wherein the drive modules are positioned in directly opposed pairs.

23. The tubing injector of claim 18, wherein each drive module is opposed and offset along the tubing axis from adjacent drive modules.

24. The tubing injector of claim 18, further comprising a tubing straightener comprising:

(a) a plurality of pairs of drive modules, each drive module comprising
a housing,
an independent drive motor with an output shaft, and
a bearing-supported roller in contact with a tubing, the roller driven by the output shaft of the drive motor,
wherein each pair of drive modules have opposed and independently driven rollers;

(b) a plurality of actuator cylinders for urging the opposed rollers together to grip the tubing;

(c) a straightener housing wherein the pairs of drive modules are mounted in a pattern selected to straighten the tubing when tubing passes through the functional path of urged opposed rollers.

25. A method for supporting and applying both transverse and longitudinal loads to coiled tubing during its injection into and withdrawal from a wellbore comprising:

(a) feeding a coiled tubing through a functional path of a tubing injector, said coiled tubing in contact with a plurality of pairs of drive modules mounted in an alternating pattern 90° apart along the axis of the tubing, each drive module having two opposed and independently driven rollers, each roller having a circumferential annular groove with an arc diameter substantially equal to an outer diameter of the tubing; and (b) operating a tensioning means in the coiled tubing injector to cause said opposed rollers to bear transversely on the coiled tubing so that tangential friction is developed between the rollers and the tubing, thereby permitting independently selected longitudinal driving forces to be transferred from each roller to the tubing when the rollers are rotationally driven by an independent drive motor and the tubing is injected into or withdrawn from a wellbore.

26. An arc corrector comprising:

(a) a plurality of flex modules, each flex module having
(iii) a tubular housing having a tube axis;
(iv) a pair of independently inwardly biased independently driven drive modules, said drive modules having a module housing, an independent drive motor with an output shaft, and a bearing-supported roller driven by the output shaft of the drive motor;
(iii) biasing means for independently urging the roller of each drive module into engagement with a tubing supported by the opposed rollers;
(iv) a plurality of coaxial linking pin holes perpendicular to and intersecting the housing tubing axis; and
(v) two cylinder mounting eyes located off the housing tube axis perpendicular to the plane defined by the linking pin hole axes and equispaced from the transverse midplane of the housing;

(b) a plurality of linking pins, wherein one linking pin engages one linking pin hole in each of two adjoining flex modules to interconnect the adjoining flex modules; and (c) a plurality of hydraulic cylinders, the cylinders cojoining the cylinder mounting eyes of adjacent flex modules, wherein selective application of pressure to the hydraulic cylinders between interlinked flex modules imparts a change in curvature to the tubing supported by the opposed rollers of the flex modules.

27. The arc corrector of claim 26, wherein the drive modules of adjoining flex modules are mounted in an alternating pattern 90° apart along the axis of the tubing passing through the flex modules.

28. The arc corrector of claim 26, wherein the roller of the drive module has a semi-toroidal annular groove with an arc diameter substantially equal to the outer diameter of the tubing supported by the roller.

29. The arc corrector of claim 26, wherein the roller comprises an independently rotatable central roller section and two independently rotatable coaxial outer roller sections, one outer section on each side of the central roller section.

30. The arc corrector of claim 26, wherein the biasing means is a spring.

31. The arc corrector of claim 30, wherein the spring is a coil spring, a Bellville spring, or a wave spring.

32. The arc corrector of claim 26, wherein the biasing means is a double-acting hydraulic cylinder.

33. An arc sensor for use with a coiled tubing rig comprising:

(a) a mounting strongback;

(b) two opposed cylinders, coaxially mounted at opposed ends of the strongback, each cylinder having a cylinder rod biased toward the center of the strongback by a cylinder precharge, wherein the cylinders have equal independent precharges; and (c) two rollers having parallel axes perpendicular to the cylinder axes, wherein one roller is mounted on the rod end of each cylinder and engages a tubing deployed between the rollers;

whereby the arc sensor is deployed in a substantially fixed position on an arcuate path of a tubing of a coiled tubing rig and its rollers engaged with said tubing such that deviations of the tubing path at the arc sensor are detectable as differential pressure differences between the two precharged cylinders.

34. A mobile coiled tubing injection system comprising:

(a) a wheeled mounting platform;

(b) a coiled tubing injector comprising
(i) a traction drive unit for imparting axial loads to tubing, said drive unit having a plurality of pairs of drive modules, each drive module comprising
a housing,
an independent drive motor with an output shaft, and
a bearing-supported roller in contact with a tubing, the roller driven by the output shaft of the drive motor,
wherein each pair of drive modules have opposed and independently driven rollers; and
(ii) tensioning means for independently controlling the axial load applied to the tubing by each roller; and
(iii) an injector housing, wherein the pairs of drive modules are mounted in the injector housing in an alternating pattern 90° apart along an axis of the injector housing;

(c) an engine driven hydraulic power source;

(d) a coiled tubing reel;

(e) a slip unit;

(f) a pivotable boom for supporting the coiled tubing injector, wherein the boom is hydraulically extensible;

(g) a blowout preventer; and (h) an adapter spool;

whereby the mobile coiled tubing injection system is easily transportable to the well site.

35. The mobile coiled tubing injection system of claim 34, wherein the wheeled mounting platform is a truck bed or trailer.

36. The mobile coiled tubing injection system of claim 34, wherein the coiled tubing reel is mounted on a laterally reciprocable wheel base.

37. The mobile coiled tubing injection system of claim 34, further comprises a thrust enhancer having:

a static tubing gripper having a closed and an open position; and a moveable tubing gripper having a closed and an open position, said movable tubing gripper being coaxially reciprocable between a first and a second position;

wherein the coiled tubing injector, the static tubing gripper and the moveable tubing gripper are positioned coaxially along the tubing and are independently selectively operable.

38. The mobile coiled tubing injection system of claim 34, further comprising a level winder.

39. The mobile coiled tubing injection system of claim 34, further comprising a gooseneck.

40. The mobile coiled tubing injection system of claim 34, further comprising an arc corrector comprising:

(a) a plurality of flex modules, each flex module having
(i) a tubular housing having a tube axis;
(ii) a pair of independently inwardly biased independently driven drive modules, said drive modules having a module housing, an independent drive motor with an output shaft, and a bearing-supported roller driven by the output shaft of the drive motor;
(iii) biasing means for independently urging the roller of each drive module into engagement with a tubing supported by the opposed rollers;
(iv) a plurality of coaxial linking pin holes perpendicular to and intersecting the housing tubing axis; and
(v) two cylinder mounting eyes located off the housing tube axis perpendicular to the plane defined by the linking pin hole axes and equispaced from the transverse midplane of the housing;

(b) a plurality of linking pins, wherein one linking pin engages one linking pin hole in each of two adjoining flex modules to interconnect the adjoining flex modules; and (c) a plurality of hydraulic cylinders, the cylinders cojoining the cylinder mounting eyes of adjacent flex modules, wherein selective application of pressure to the hydraulic cylinders between interlinked flex modules imparts a change in curvature to the tubing supported by the opposed rollers of the flex modules.

41. The mobile coiled tubing injection system of claim 34, further comprising an arc sensor comprising:

(a) a mounting strongback;

(b) two opposed cylinders, coaxially mounted at opposed ends of the strongback, each cylinder having a cylinder rod biased toward the center of the strongback by a cylinder precharge, wherein the cylinders have equal independent precharges; and (c) two rollers having parallel axes perpendicular to the cylinder axes, wherein one roller is mounted on the rod end of each cylinder and engages a tubing deployed between the rollers;

whereby the arc sensor is deployed in a substantially fixed position on an arcuate path of a tubing of a coiled tubing rig and its rollers engaged with said tubing such that deviations of the tubing path at the arc sensor are detectable as differential pressure differences between the two precharged cylinders.

42. A mobile tubing injection system for stalked tubing work, the injection system comprising:

(a) a wheeled mounting platform;

(b) a tubing injector comprising
(i) a traction drive unit for imparting axial loads to tubing, said drive unit having a plurality of pairs of drive modules, each drive module comprising
a housing,
an independent drive motor with an output shaft, and
a bearing-supported roller in contact with a tubing, the roller driven by the output shaft of the drive motor,
wherein each pair of drive modules have opposed and independently driven rollers;
(ii) tensioning means for independently controlling the axial load applied to the tubing by each roller; and
(iii) an injector housing, wherein the pairs of drive modules are mounted in the injector housing in an alternating pattern 90° apart along an axis of the injector housing;

(c) an engine driven hydraulic power source;

(d) a slip unit; and (e) a pivotable boom for supporting the tubing injector, the boom is hydraulically extensible;

(f) a blowout preventer;

(g) a thrust enhancer;

(h) an adapter spool;

(i) a mast;

(j) a mast erection cylinder; and (k) a mast pedestal whereby the mobile tubing injection system is easily transportable to the well site.

* * * * *